US009920764B2

(12) United States Patent
Shafer et al.

(10) Patent No.: US 9,920,764 B2
(45) Date of Patent: Mar. 20, 2018

(54) PUMP DEVICES

(71) Applicant: PEOPLEFLO MANUFACTURING, INC., Franklin Park, IL (US)

(72) Inventors: Clark J. Shafer, Bolingbrook, IL (US); William R. Blankemeier, Oak Park, IL (US); James A. Nard, Crestwood, IL (US); Jorge G. Murphy, Bolingbrook, IL (US); Radosav Trninich, Elmhurst, IL (US); Kris Malorny, Downers Grove, IL (US)

(73) Assignee: PEOPLEFLO MANUFACTURING, INC., Franklin Park, IL (US)

( * ) Notice: Subject to any disclaimer, the term of this patent is extended or adjusted under 35 U.S.C. 154(b) by 0 days.

(21) Appl. No.: 15/277,778

(22) Filed: Sep. 27, 2016

(65) Prior Publication Data

US 2017/0191481 A1 Jul. 6, 2017

Related U.S. Application Data

(60) Provisional application No. 62/235,255, filed on Sep. 30, 2015.

(51) Int. Cl.

| | |
|---|---|
| ***F04D 13/02*** | (2006.01) |
| ***F04D 13/06*** | (2006.01) |
| ***F04D 29/24*** | (2006.01) |
| ***F04D 29/046*** | (2006.01) |

(52) U.S. Cl.

CPC ..... *F04D 13/027* (2013.01); *F04D 13/06* (2013.01); *F04D 29/046* (2013.01); *F04D 29/24* (2013.01); *F04C 2240/20* (2013.01); *F04C 2240/30* (2013.01); *F04C 2240/40* (2013.01); *F04C 2240/56* (2013.01)

(58) Field of Classification Search

CPC ..... F04D 13/027; F04D 13/06; F04D 29/046; F04D 29/24

See application file for complete search history.

(56) References Cited

U.S. PATENT DOCUMENTS

| | | | |
|---|---|---|---|
| 3,309,009 | A | 3/1967 | Culk |
| 3,395,644 | A | 8/1968 | Grebel |
| 4,047,847 | A | 9/1977 | Oikawa |
| 4,065,234 | A | 12/1977 | Yoshiyuki et al. |
| 4,207,485 | A | 6/1980 | Silver |
| 4,226,574 | A | 10/1980 | Villette |
| 4,304,532 | A | 12/1981 | McCoy |
| 4,645,432 | A | 2/1987 | Tata |
| 4,648,808 | A | 3/1987 | Hauenstein |
| 4,752,194 | A | 6/1988 | Wienen et al. |
| 4,780,066 | A | 10/1988 | Bolleter et al. |

(Continued)

FOREIGN PATENT DOCUMENTS

| | | | |
|---|---|---|---|
| DE | 4009199 | A | 9/1991 |
| DE | 202004013080 | U1 | 1/2006 |

(Continued)

OTHER PUBLICATIONS

PCT Search Report and Written Opinion for PCT/US2013/054213 dated Dec. 8, 2016 (related PCT Application).

*Primary Examiner* — Patrick Hamo
(74) *Attorney, Agent, or Firm* — Cook Alex Ltd.

(57) ABSTRACT

The disclosure provides pumps that include improvements in construction, which involve bearing surfaces, recirculation paths, mounting footprints, impeller vane starting diameters, canister assemblies, and rotor assembly bushing configurations.

20 Claims, 18 Drawing Sheets

(56) References Cited

U.S. PATENT DOCUMENTS

| | | | |
|---|---|---|---|
| 4,850,818 | A | 7/1989 | Kotera |
| 4,890,988 | A | 1/1990 | Krämer et al. |
| 4,952,429 | A | 8/1990 | Schmitz et al. |
| 4,998,863 | A | 3/1991 | Klaus |
| 5,045,026 | A | 9/1991 | Buse |
| 5,149,253 | A | 9/1992 | Miyamoto et al. |
| 5,201,642 | A | 4/1993 | Hinckley |
| 5,248,245 | A | 9/1993 | Behnke et al. |
| 5,253,986 | A | 10/1993 | Bond et al. |
| 5,269,664 | A | 12/1993 | Buse |
| 5,288,213 | A | 2/1994 | Nasr |
| 5,332,374 | A | 7/1994 | Kricker et al. |
| 5,368,439 | A | 11/1994 | Piazza |
| 5,407,331 | A | 4/1995 | Atsumi |
| 5,464,333 | A | 11/1995 | Okada et al. |
| 5,501,582 | A | 3/1996 | Gautier et al. |
| 5,580,216 | A | 12/1996 | Munsch |
| 5,763,973 | A | 6/1998 | Cramer |
| 5,915,931 | A | 6/1999 | Lindner et al. |
| 6,039,827 | A | 3/2000 | Cramer |
| 6,095,770 | A | 8/2000 | Obata et al. |
| 6,264,440 | B1 | 7/2001 | Klein et al. |
| 6,293,772 | B1 | 9/2001 | Brown et al. |
| 6,302,661 | B1 | 10/2001 | Khanwilkar et al. |
| 6,417,591 | B1 | 7/2002 | Saito et al. |
| 6,443,710 | B1 | 9/2002 | Tatsukami et al. |
| 6,445,098 | B1 | 9/2002 | Materne |
| 6,457,951 | B2 | 10/2002 | Rennett et al. |
| 6,524,083 | B2 | 2/2003 | Deai et al. |
| 6,551,075 | B2 | 4/2003 | Gabriele et al. |
| 6,554,576 | B2 | 4/2003 | Rennet et al. |
| 6,607,370 | B2 | 8/2003 | Fukarnachi et al. |
| 6,626,644 | B2 | 9/2003 | Ozaki |
| 6,672,818 | B1 | 1/2004 | Terracol et al. |
| 6,908,291 | B2 | 6/2005 | Klein et al. |
| 7,033,146 | B2 | 4/2006 | Shi |
| 7,048,518 | B2 | 5/2006 | Oliveira et al. |
| 7,057,320 | B2 | 6/2006 | Abordi et al. |
| 7,101,158 | B2 | 9/2006 | Hembree et al. |
| 7,137,793 | B2 | 11/2006 | Shafer et al. |
| 7,249,939 | B2 | 7/2007 | Yanagihara et al. |
| 7,467,930 | B2 | 12/2008 | Ozaki et al. |
| 7,500,829 | B2 | 3/2009 | Edwards et al. |
| 7,549,205 | B2 | 6/2009 | Shafer |
| 7,572,115 | B2 | 8/2009 | Klein et al. |
| 7,707,720 | B2 | 5/2010 | Klein et al. |
| 7,871,254 | B2 | 1/2011 | Ito |
| 8,079,828 | B2 | 12/2011 | Togawa et al. |
| 8,333,666 | B2 | 12/2012 | Ekberg et al. |
| 8,597,000 | B2 | 12/2013 | Chien et al. |
| 8,956,067 | B2 | 2/2015 | Schneider et al. |
| 8,957,552 | B2 | 2/2015 | Hansen et al. |
| 9,071,091 | B2 | 6/2015 | D'Antonio |
| 2009/0104057 | A1 | 4/2009 | Kishi |
| 2013/0171011 | A1 | 7/2013 | Blankemeier et al. |
| 2013/0171012 | A1 | 7/2013 | Blankemeier et al. |
| 2013/0221769 | A1 | 8/2013 | Hansen et al. |
| 2014/0234142 | A1 | 8/2014 | Mischiatti et al. |
| 2015/0206637 | A1 | 7/2015 | Schneider et al. |
| 2015/0260191 | A1 | 9/2015 | Blankemeier et al. |
| 2015/0337844 | A1 | 11/2015 | Eschner |
| 2016/0305433 | A1 | 10/2016 | Eschner |

FOREIGN PATENT DOCUMENTS

| | | | |
|---|---|---|---|
| JP | 2005330908 | | 12/2005 |
| JP | 2011021596 | A | 2/2011 |
| RO | 123090 | B1 | 9/2010 |

PUMP DEVICES

BACKGROUND

Field of the Invention

The present invention generally relates to pumps, which could be in various configurations, such as in the form of rotodynamic or centrifugal pumps, or positive-displacement pumps, and which may be magnetically driven or may have dynamic seals.

Description of the Related Art

Many pumps utilize dynamic seals, which are mechanical seals between rotating parts. However, in some pumping applications, it is desirable to try to avoid potential seal leakage by not using seals in conjunction with rotating parts. Accordingly, in some instances, it is becoming more common in the pump arts to employ a magnetic drive system to eliminate the need for seals along rotating surfaces. The present disclosure addresses numerous shortcomings in prior art equipment, such as pumps, some of which utilize a magnetic coupling, while others of which may be employed with pumps having seals along rotating surfaces. The pumps also may employ rotodynamic or positive-displacement pumping principles. The following are several of the shortcomings recognized and sought to be addressed in the present disclosure.

Prior art systems for supporting a rotor assembly within a magnetically driven pump may be of different constructions but tend to provide radial and axial (thrust) bearing support for the rotor assembly that does not rely on the canister that separates the fluid pumping chamber from the drive portion of the pump. This results in a disadvantage of causing magnetically driven pumps to have greater axial length and weight, because the bearing support is located forward and/or rearward of the pumping portion of the rotor assembly. For example, bearings providing radial support and forward and rearward thrust or axial bearings that restrict forward or rearward motion typically are located forward and/or rearward of the pumping elements of a rotor assembly.

Almost all magnetically coupled pumps have a recirculation path that allows a small percentage of the pump fluid flow to recirculate from the pump outlet or discharge side, back to the inlet or suction side. This recirculation is used mostly for lubrication and cooling of bushings and for cooling of the canister, which may get hot due to electrical eddy currents generated by the magnetic coupling. Prior art recirculation paths include one or more segments where the path is essentially a hole thru a single part, such as a hole thru a single stationary part of the pump casing or thru a single piece rotating impeller. The downside of a hole thru a single part is that it is prone to causing clogging of the recirculation path.

In the chemical processing industry, the standard ASME B73.1 is a very popular specification for most centrifugal dynamically sealed pumps. In this standard and in the ISO 5199 standard, one of the main features of the specification is the establishment of a common mounting footprint, including the sizes and locations of the outlet or discharge port, the inlet port, the mounting foot and the shaft of the pump. The industry also sells magnetically coupled pumps but they utilize a different rear end mechanical drive portion or power end in comparison to the dynamically sealed pumps. There are far fewer magnetically coupled pumps, so the power ends for magnetically driven pumps tend to be more costly. Also, due to overall size and especially axial length, no magnetically coupled pumps known to the inventors have been able to utilize the power end that is commonly used with the dynamically sealed pumps while meeting either of the standards for the location of the stated features involved in mounting such pumps.

When a rotor assembly of a pump includes an impeller, the pump generally is most efficient and has the best suction capability when the center starting ends of the vanes have a relatively small diameter. However, in a magnetically driven rotodynamic pump, a front nose cap that holds a front axial bearing is most beneficial if it has a relatively large outer diameter, so that the axial bearing can be large. In a typical design, a nose cap must be assembled from the front of the impeller, so the center of the forward ends of the impeller vanes must start at a diameter at least as large as the diameter of the nose cap. This requires a disadvantageous tradeoff pitting a desired small diameter for the front end of the impeller vanes against a desired large diameter of a front axial bearing.

As noted above, it is common for pumps to have separate radial and axial bushings or bearings. This tends to add undesirable complexity and length to a pump.

The above are some of the shortcomings of prior art pumps that are sought to be addressed by the teachings and examples provided in the present disclosure.

SUMMARY

In a first aspect, the present disclosure provides a magnetically driven pump having a compact advantageous design that overcomes the above discussed disadvantages associated with having radial and axial bearing surfaces well forward or rearward of the pumping area of a rotor assembly. The disclosure provides a magnetically driven pump that includes a casing, a rotor assembly, an inner magnet assembly and a canister assembly. The casing has a front portion, a rear portion, a discharge port and an inlet port. The rotor assembly includes a rear cylindrical opening having an inner wall surface and having a plurality of magnet segments connected to the inner wall surface, a front cylindrical opening having an inner wall surface that provides a radial bearing surface, and a first axial bearing surface. The canister assembly includes a cylindrical portion disposed within a radial gap between magnet segments of the inner magnet assembly and magnet segments of the rotor assembly, and a front portion extending from the cylindrical portion and having a radial bearing surface and a first axial bearing surface. In this design, the radial bearing surface of the rotor assembly and the radial bearing surface of the canister assembly front portion restrict radial motion of the rotor assembly, and the first axial bearing surface of the rotor assembly and the first axial bearing surface of the canister assembly front portion restrict forward motion of the rotor assembly.

In a second aspect, the present disclosure addresses the disadvantageous structures of prior art magnetically driven pumps having a recirculation path through a single part or through stationary segment. The disclosure provides a magnetically driven pump that includes a stationary casing, a rotatable rotor assembly, a rotatable drive magnet assembly, a stationary canister assembly, and a recirculation path. The stationary casing has a front portion, a rear portion, a discharge port and an inlet port. The rotatable rotor assembly includes a rotor, at least one radial bearing surface, at least one axial bearing surface and a plurality of magnet segments. The rotatable drive magnet assembly includes a plurality of magnet segments in axial alignment with the magnet segments of the rotor assembly. The stationary canister assembly includes a cylindrical portion disposed within a radial gap between the magnet segments of the rotor assembly and the magnet segments of the drive magnet assembly. The recirculation path extends from the casing discharge port, across the at least one radial bearing surface of the rotor assembly, across the at least one axial bearing surface of the rotor assembly, across the cylindrical portion of the canister assembly, and to the casing inlet port, wherein when the rotor assembly rotates within the casing and relative to the canister assembly, all portions of the recirculation path include at least one stationary surface of the casing or canister assembly that is opposed to at least one surface of the rotor assembly.

In a third aspect, the present disclosure also addresses the lack of magnetically driven pumps able to meet the industry standards ASME B73.1 and/or ISO 5199 for mounting locations of key features and able to utilize the rear end mechanical drive portion commonly used with dynamically sealed pumps that meet the standard. The disclosure provides a magnetically driven rotodynamic pump that includes a stationary casing, an inner magnet assembly, and an impeller assembly. The stationary casing includes a discharge port, an inlet port, a mounting foot and a rear mounting flange. The inner magnet assembly has an inner ring and a plurality of magnet segment. The casing, inner magnet assembly and impeller assembly are configured and dimensioned to be assembled to a power end and adapter of a commercially available non-magnetically driven rotodynamic pump having a dynamic seal that is designed in accordance with dimensions specified in a pump industry standard, such that when assembled, the sizes and locations of the casing discharge port, the casing inlet port, the casing mounting foot, and the power end and adapter all meet the dimensions specified in the standard. The unique, axially compact design of a pump of the present disclosure is capable of utilizing the rear end mechanical drive components or power end normally in place for such centrifugal dynamically sealed pumps. Thus, the pump may be installed without needing to remove the power end that is connected to the electric drive motor, and therefore, without disturbing the electric motor and its mounting and electrical connections, and without disturbing the shaft alignment between the electric motor and the power end. Also, the new pump advantageously may be connected to existing power end and adaptor structures. This can be particularly beneficial to manufacturers that already make the power end and adapter components for the centrifugal dynamically sealed pumps. Moreover, it permits utilization of the less expensive power ends normally used with dynamically sealed pumps, and provides an opportunity for field retrofits that can be achieved by leaving in place the existing power end and only changing out the pump, while also gaining the advantages of a magnetically driven pump.

In a fourth aspect, the present disclosure addresses the previously noted issue that typical magnetically driven rotodynamic pumps having a front axial bearing at a nose cap must balance the benefit of having a small diameter at the center starting portion of the impeller vanes against the benefit of having a large diameter canister nose cap for the front axial bearing. The disclosure provides a magnetically driven rotodynamic pump having a stationary casing, a stationary canister assembly, and a rotatable rotor assembly. The stationary casing has a front portion, a rear portion, a discharge port and an inlet port. The stationary canister assembly is connected to the stationary casing. The stationary canister assembly further includes a canister and a stationary nose cap is connected to the canister and has an outer diameter, a rear axial bearing surface and a front surface. The rotatable rotor assembly includes an impeller having a plurality of front vanes, wherein a portion of the impeller front vanes extend forward of the nose cap front surface and inward to an inner diameter that is smaller than the outer diameter of the nose cap. Thus, the design includes the benefits of both a smaller diameter at the center starting portion of the impeller vanes and a large diameter canister nose cap having a front axial bearing. In this design, the stationary front surface of the nose cap is positioned where there would otherwise be an impeller base surface and the forward extending portions of the impeller vanes extend forward of the surface of the base of the impeller. This results in an advantageous relatively small diameter of the center starting ends of the impeller vanes combined with an advantageous relatively large outer diameter of the axial bearing at the nose cap of the canister assembly.

In a fifth aspect, the present disclosure provides a pump that includes a stationary casing having a front portion, a rear portion, a discharge port and an inlet port, and further includes a rotor assembly having a bushing wherein the bushing is of single piece construction and includes a radial bearing surface that restricts radial motion of the rotor assembly, a front axial bearing surface that restricts forward motion of the rotor assembly, and a rear axial bearing surface that restricts rearward motion of the rotor assembly. This design is believed to provide the first instance of a pump having a bushing for a rotor assembly that is of single piece construction while providing radial and front and rear axial bearing surfaces. This provides a particularly compact rotor assembly design.

In an sixth aspect, the present disclosure provides a pump that includes a stationary casing having a front portion, a rear portion, a discharge port and an inlet port, and further includes a rotor assembly having a rotor that includes a central opening extending axially through the rotor and having a step proximate one end of the central opening, a rotor ring, and a bushing, wherein the bushing fits inside the rotor central opening and is held in place between the rotor ring and the step in the central opening of the rotor. This design provides a uniquely compact and efficient bushing design and construction for a rotor assembly wherein a bushing extends through a portion of and is held within the rotor assembly by a fastening means at one end of the rotor assembly. This also enables the use of advantageous longer bearing surfaces.

It is to be understood that both the foregoing general description and the following detailed description are exemplary and provided for purposes of explanation only, and are not restrictive of the subject matter claimed. Further features and objects of the present disclosure will become more fully apparent in the following description of the preferred embodiments and from the appended claims. Indeed, it is contemplated that certain aspects of the present disclosure pertain to pumps that may be dynamically sealed and/or magnetically driven and considered to be sealless, while certain aspects also pertain to rotodynamic pumps and/or positive-displacement pumps. It also will be appreciated that, if magnetically driven, some aspects may be applied to pumps having an inner magnet drive assembly and/or an outer magnet drive assembly.

BRIEF DESCRIPTION OF THE DRAWINGS

In describing the preferred embodiments, references are made to the accompanying drawing figures wherein like parts have like reference numerals, and wherein.

It should be understood that the drawings are not to scale. While some mechanical details of the example pumps, including details of fastening means and other plan and section views of the particular components, have not been shown, such details are considered to be within the comprehension of those skilled in the art in light of the present disclosure. It also should be understood that the present disclosure and claims are not limited to the preferred embodiments illustrated.

DETAILED DESCRIPTION

Referring generally to FIGS. 1-21, it will be appreciated that pumps devices of the present disclosure generally may be embodied within numerous configurations. Indeed, the teachings within this disclosure may pertain to dynamically sealed pumps, whether of the rotodynamic or positive-displacement types, and/or to magnetically driven or sealless pumps, whether of the rotodynamic or positive-displacement types. If of the magnetically driven type, the pumps may be of the inner magnet drive and/or outer magnet drive types.

Figure 1:
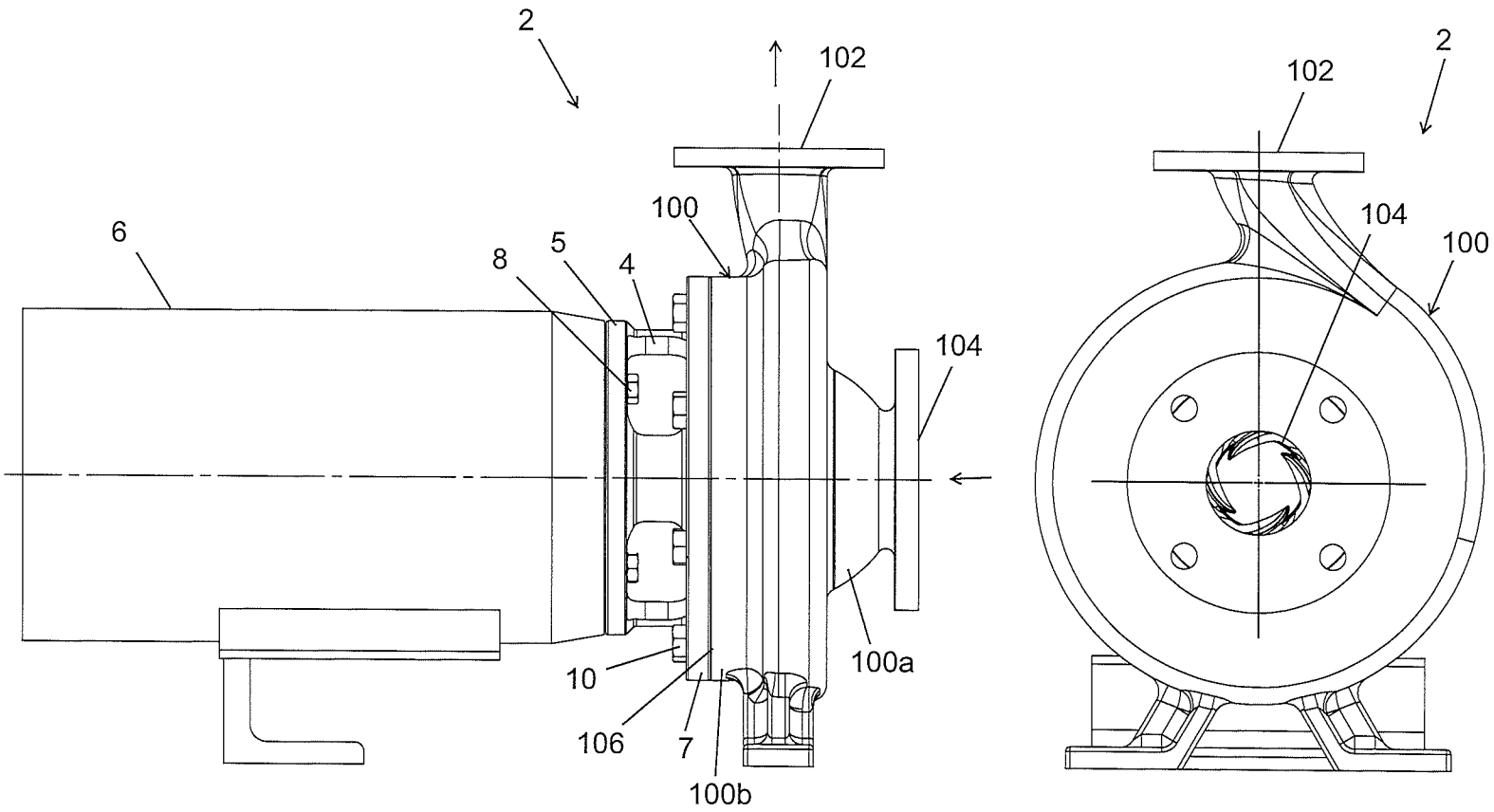
FIG. 1 provides a side view and a front view of a first example pump connected to a motor using an adapter and shaft extension in a close-coupled fashion.
Figure 2:
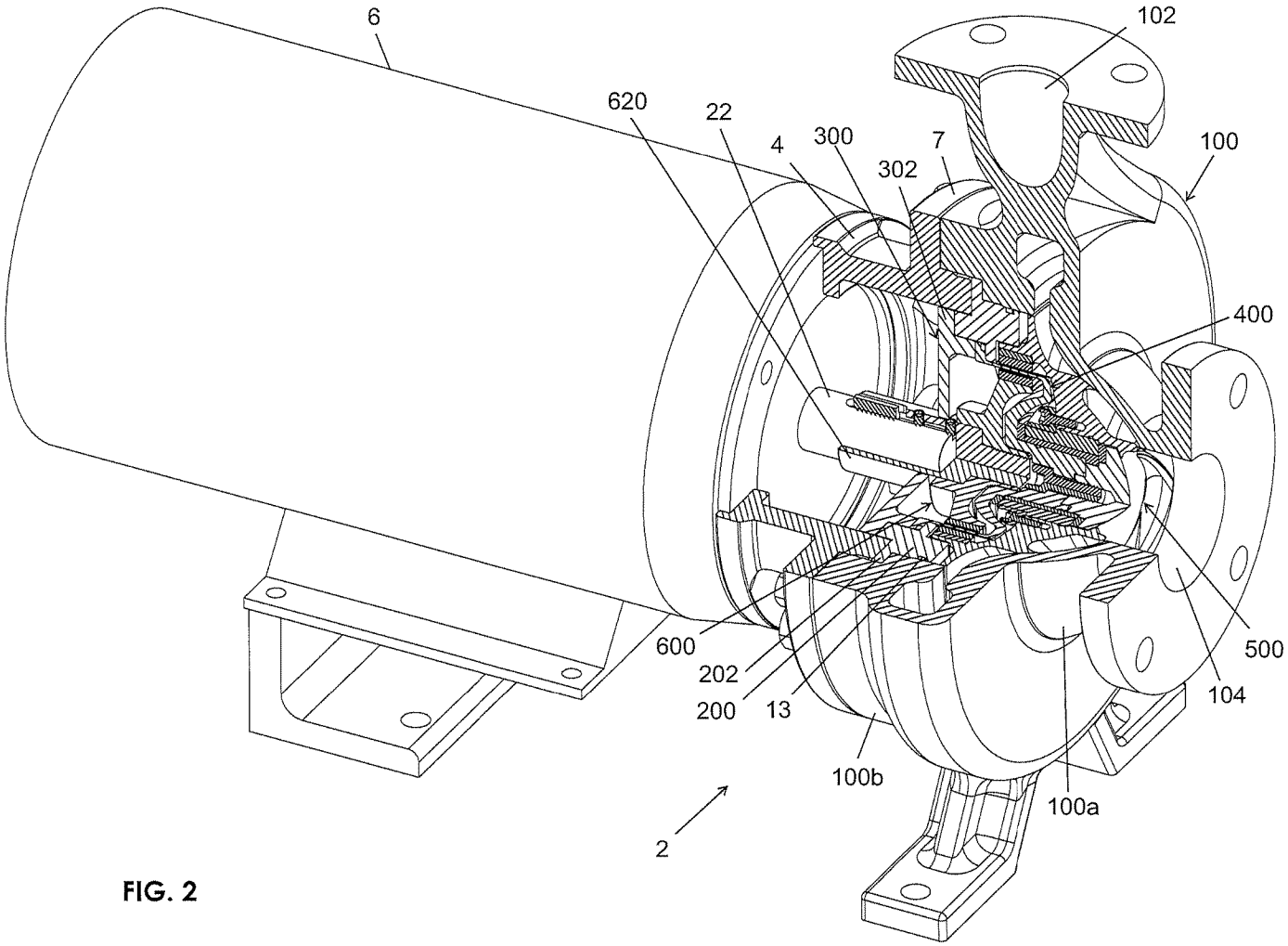
FIG. 2 provides a quarter-sectioned perspective view of the first example pump of FIG. 1.

Referring to a preferred first example embodiment, in FIGS. 1-10, and particularly to FIGS. 1 and 2, an example pump 2 is shown connected to a motor adapter 4 that, in turn, is connected to a standard C-face electric motor 6. The configuration of pump 2 happens to be a magnetically driven rotodynamic pump. More particularly, a first flange 5 of the adapter 4 is connected to the motor 6 by use of a plurality of fasteners 8, such as threaded screws or other suitable means of connection. In this first example, the motor 6 includes a motor shaft 22 to which is connected a shaft extension 620, and it will be appreciated that in combination with the adapter 4, these components provide the rear end mechanical drive portion or power end that is connected to the pump 2.

The pump 2 includes a casing 100 that is intended to be mounted in place, so as to be stationary. The casing 100 includes a front portion 100*a* and a rear portion 100*b*. The casing 100 also has an outlet or discharge port 102 and an inlet port 104. In this first example, the discharge port 102 is radially facing, while the inlet port 104 is axially facing, although alternative configurations may be utilized. The casing 100 includes a rear face 106 that is connected to a second flange 7 of the adapter 4 by use of a plurality of fasteners 10 that pass through apertures in the second flange 7 and engage threaded holes in the casing rear face 106. The casing 100 may be constructed of rigid materials, such as steel, stainless steel, cast iron or other metallic materials, or structural plastics or the like.

Figure 9:
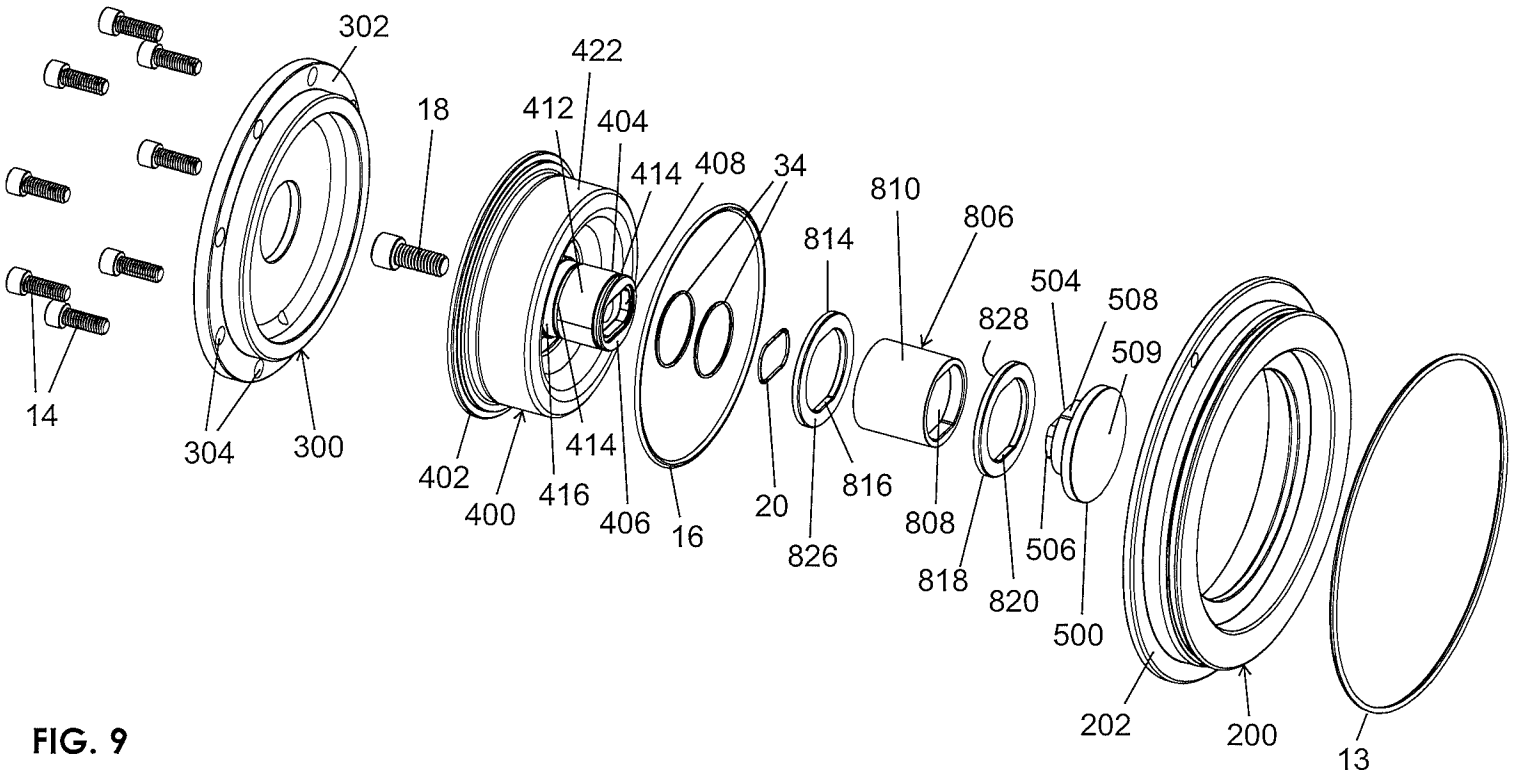
FIG. 9 provides a perspective exploded view of the center portion of the first example pump of FIG. 1.

As may be seen in FIGS. 2 and 9, the pump 2 also includes a backplate 200 that has an outer flange 202. The backplate outer flange 202 is clamped between the casing 100 and the adapter 4 when connecting the pump 2 to the adapter 4 by installing the fasteners 10. Sealing is provided between the casing 100 and the backplate 200 by an O-ring 13, although other methods of sealing may be employed, such as use of a gasket, liquid sealant or the like. The pump 2 also includes a rear cover 300 that has an outer flange 302. The rear cover 300 is connected to the backplate 200 by use of a plurality of fasteners 14, such as threaded screws that pass through apertures 304 in the rear cover 300 and engage threaded holes in a rear face of the backplate 200.

The pump 2 also includes a canister assembly 400 that includes a canister 400*a* that has an outer flange 402. The canister outer flange 402 is clamped between the backplate 200 and the rear cover 300 when connecting the rear cover 300 to the backplate 200 by installing the fasteners 14. Sealing is provided between backplate 200 and the canister assembly 400 by an O-ring 16, although other methods of sealing may be employed, such as use of a gasket, liquid sealant or the like. The canister assembly 400 also includes a front portion 404 that includes a front face 406 having a front cavity 408 and an aperture 410 that passes through the front portion 404. The canister assembly 400 may be constructed of rigid materials. It will be appreciated that common materials may be used, such as stainless steel, or low conductivity metals, such as alloy C-22 or alloy C-276, and it could be advantageous to use materials having very low electrical conductivity, such as silicon carbide, ceramic, polymers or the like.

In addition, the canister assembly 400 includes a nose cap 500, which has a threaded hole 502, a rear face 504 and a rear extended portion 506. The nose cap 500 is attached to the canister assembly front portion 404 by a fastener 18, such as a threaded screw that passes through the aperture 410 in the front portion 404 and engages the threaded hole 502 in the rear of the nose cap 500. In this first example embodiment, there is just one fastener 18 securing the nose cap 500, but it will be appreciated by one of skill in the art that a plurality of fasteners or other suitable fastening means may be employed in assembling the components of the canister assembly 400. Also, in this first example pump 2, the front portion 404 and nose cap 500 of the canister assembly 400 are spaced from the front portion 100*a* of the casing 100, such that they do not receive support from the front portion 100*a*. The nose cap 500 may be constructed of rigid materials, such as steel, stainless steel, cast iron or other metallic materials, or structural plastics or the like.

The shape of the front cavity 408 is not cylindrical, and it corresponds to a non-cylindrical shape of the nose cap extended portion 506, so as to prevent relative rotation between the nose cap 500 and canister 400*a* when connected by the fastener 18, and to ensure that the canister assembly will remain stationary. Throughout this disclosure, it will be appreciated that alternative ways of preventing relative rotation between components may be used, such as by use of one or more fasteners, welding or other suitable alternatives. Sealing between the canister 400*a* and the nose cap 500 is provided by an O-ring 20, although other methods of sealing may be employed, such as use of a gasket, liquid sealant or the like.

The pump 2 further includes a drive magnet assembly, such as an inner magnet assembly 600 that includes an inner ring 640 which may be connected directly to a motor shaft, or in this example, to the shaft extension 620. The inner ring 640 has a central threaded aperture 642 and the shaft extension 620 has a mating externally threaded front portion 622, which is used to connect the inner ring 640 to the shaft extension 620. In this first example embodiment, the shaft extension 620 and inner ring 640 are separate pieces, but it will be appreciated that they could be combined, so as to be a single piece, or a different method of connection may be used. The inner ring 640 may be constructed of rigid materials, but is preferably constructed of a material with high magnetic permeability, such as iron, carbon steel or the like.

The shaft extension 620 of this example includes an inner opening 624 that slidably receives a shaft 22 of the motor 6. The shaft extension 620 also includes a keyway 626 and one or more threaded apertures 628. A key 24 is positioned in the shaft extension keyway 626 and engages with a keyway 26 of the motor shaft 22, to provide a positive rotational connection between the shaft extension 620 and the motor shaft 22. One or more setscrews 28 are positioned in the shaft extension threaded apertures 628 and are tightened against the keyway 26 of the motor shaft 22, to provide a positive axial connection between the shaft extension 620 and the motor shaft 22.

The inner ring 640 of the drive magnet assembly, such as inner magnet assembly 600 includes an outer surface 644 to which are connected twenty-four magnet segments 646, although it will be appreciated that one may have an embodiment with a different quantity of magnet segments. The magnet segments 646 are radially charged and are positioned with alternating polarity. The magnet segments 646 are rigidly connected to the inner ring 640 using an adhesive, although alternative suitable means of connection may be used, such as use of fasteners or the like. Although not required, this example embodiment includes an inner magnet sleeve 648 having a thin cylindrical portion 650 that closely fits over the outer surfaces of the magnet segments 646.

The pump 2 also includes a rotatable rotor assembly, such as a rotatable impeller assembly 700 that includes a rotor, such as an impeller 702. The impeller 702 includes a rear opening 704, which receives a driven magnet assembly, such as an outer magnet assembly 705. The outer magnet assembly 705 includes an outer ring 706 having an inner wall surface 708 to which are connected twenty-four magnet segments 710, which corresponds to the number connected to the inner ring 640, although it will be appreciated that one may have an embodiment with a greater or lesser quantity of magnet segments. The magnet segments 710 are radially charged and are positioned with alternating polarity. The magnet segments 710 are rigidly connected to the outer ring 706 using an adhesive, although alternative suitable means of connection may be used, such as use of fasteners or the like. An impeller magnet sleeve 712 is included having a thin cylindrical portion 714 that closely fits along the inner surfaces of the magnet segments 710. The impeller magnet sleeve 712 also includes a rear flange 718. The impeller magnet sleeve 712 is sealingly connected to the impeller 702 by continuous weld joints located at an outer end 720 of the rear flange 718 and at a front end 722 of the cylindrical portion 714. It will be appreciated by one of skill in the art that other methods of connection may be used, such as liquid adhesive, gaskets, O-rings or the like. The rotor or impeller 702 may be constructed of rigid materials, such as steel, stainless steel, cast iron or other metallic materials, or structural plastics or the like. The outer ring 706 may be constructed of rigid materials, but preferably is constructed of a material with high magnetic permeability, such as iron, carbon steel or the like.

Figure 6B:
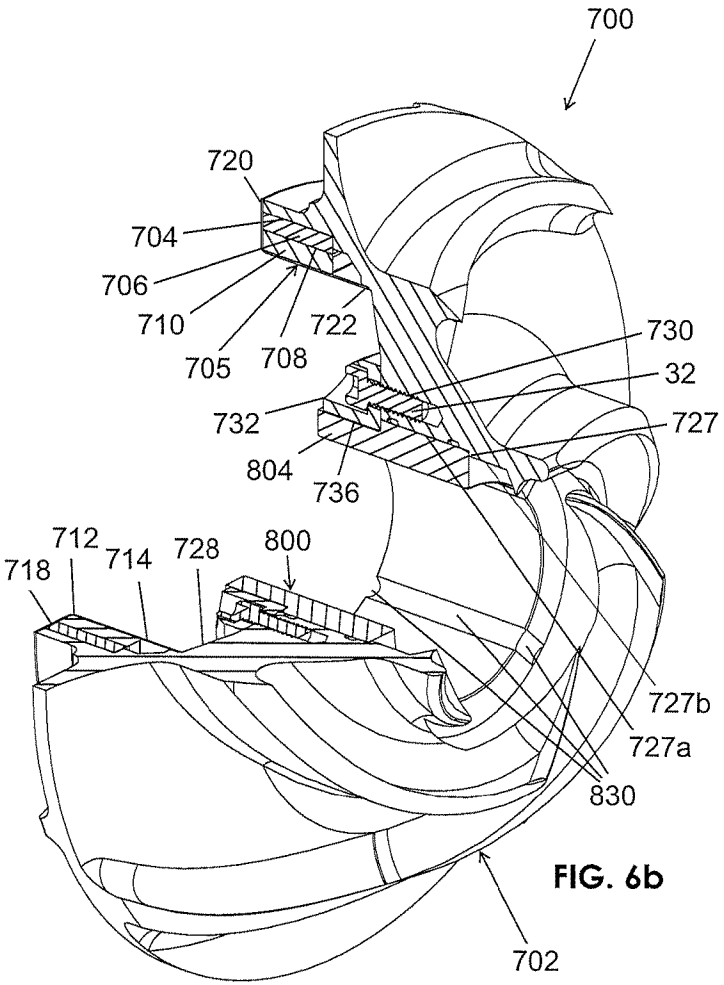
FIGS. 6*a* and 6*b* provide quarter-sectioned rear and front perspective views of the rotor assembly of the first example pump of FIG. 1.
Figure 6A:
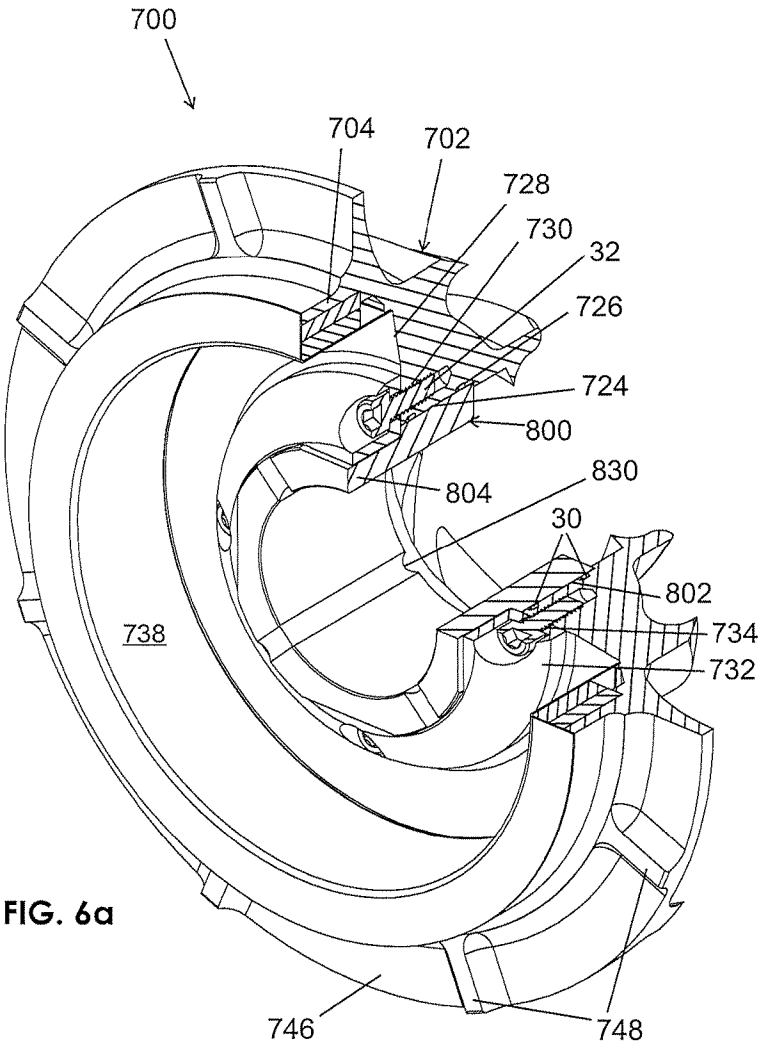
Figure 7:
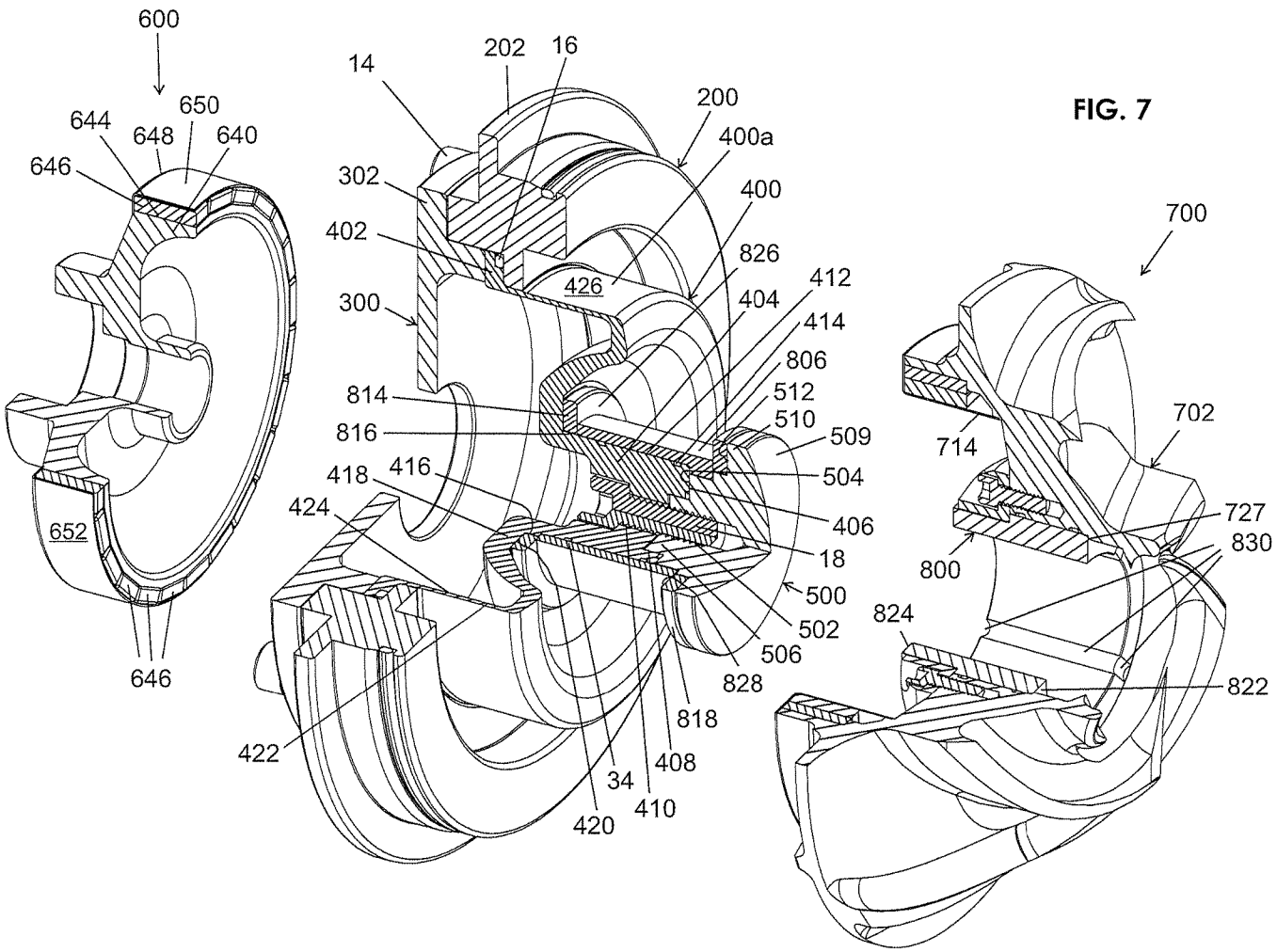
FIG. 7 provides a quarter-sectioned perspective partially exploded view of the inner portion of the first example pump of FIG. 1.
Figure 8:
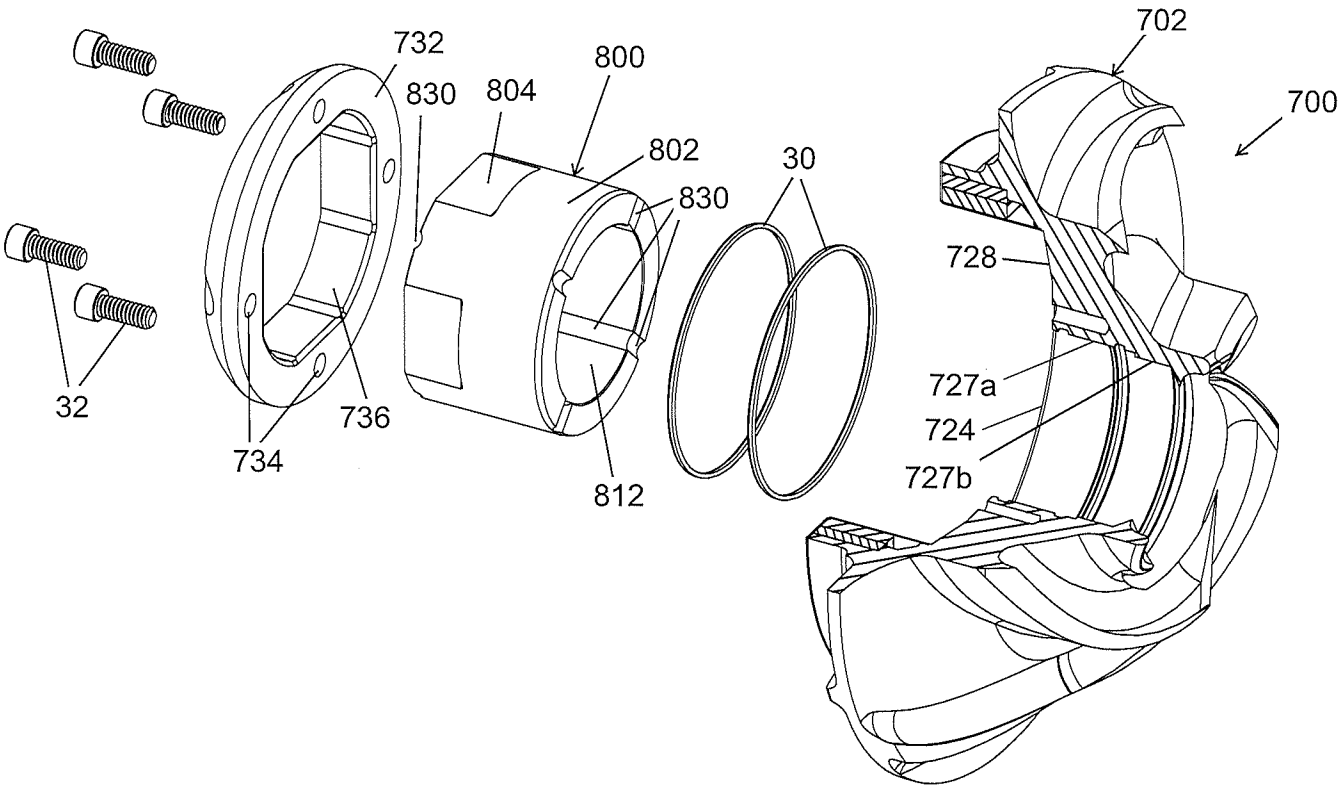
FIG. 8 provides a partially quarter-sectioned perspective partially exploded view of the rotor assembly of the first example pump of FIG. 1.

Referring to FIGS. 6*a* and 6*b*, the rotatable rotor assembly or impeller assembly 700 includes a rotor or impeller 702 having a central opening 724 that includes one or more grooves 726. A bushing 800 is received in the central opening 724 of the rotor or impeller 702, and one or more O-rings 30 are positioned between an outer surface 802 of the bushing 800 and the grooves 726 in the central opening 724 of the impeller 702. The bushing 800 is held in a forward direction against a step 727 in the central opening 724 proximate an end of the central opening 724 of the impeller 702, where there is a transition from a first inner surface 727*a* to a second inner surface 727*b* having a smaller diameter. The bushing outer surface 802 is slightly smaller than the rotor or impeller central opening 724, and the O-rings 30 are not intended to provide sealing between the two surfaces. Rather, in the event that the operating temperature may vary, and the bushing 800 and the impeller 702 may be made of materials with different rates of thermal expansion, then the size or extent of the clearance between the bushing 800 and impeller 702 will change and the compression of the O-rings 30 of this example embodiment will accommodate this clearance change and will maintain a concentric relationship between the bushing 800 and the impeller 702.

The rotor or impeller 702 further includes a rear surface 728 that includes one or more threaded holes 730. An impeller rear cap, such as rotor ring 732 having a central opening 736 is connected to the impeller rear surface 728 by at least one fastener 32, such as by a plurality of screws that pass through apertures 734 in the rotor ring 732 and engage the threaded holes 730 in the impeller 702. The bushing 800 includes a rear portion 804 with a shape that is not cylindrical, and it corresponds to a non-cylindrical shape of the central opening 736 in the rotor ring 732 to prevent relative rotation between the bushing 800, rotor ring 732 and impeller 702, although as previously noted, alternative ways of preventing relative rotation may be utilized. Thus, the bushing 800 fits inside the central opening 736 extending axially through the rotor or impeller 702 and is held in place between the rotor ring 732 and the step 727 in the central opening 736 of the impeller 702.

As will be further described and more fully appreciated, within this first example pump 2, the bushing 800 provides the rotatable rotor assembly or impeller assembly 700 a radial bearing surface, a first or front axial bearing surface, and a second or rear axial bearing surface. In this example, these bearing surfaces engage respective bearing surfaces of the canister assembly 400, which as will be described further herein more particularly include a radial bearing surface provided by a bearing sleeve 806, a first or front axial bearing surface provided by a front thrust washer 818, and a second or rear axial bearing surface provided by a rear thrust washer 814.

Thus, the canister assembly 400 of the first example pump 2 also includes a stationary bearing sleeve 806 that has a cylindrical shape. The front portion 404 of the canister 400*a* includes an outer surface 412 having at least one groove 414. The bearing sleeve 806 is positioned over the outer surface 412 of the front portion 404, and at least one O-ring 34 is positioned between the outer surface groove 414 of the front portion 404 and an inner surface 808 of the bearing sleeve 806. In this example embodiment, two O-rings 34 are received in two grooves 414. The outer surface 412 of the front portion 404 of the canister 400*a* is slightly smaller than the inner surface 808 of the bearing sleeve 806. In the event that the operating temperature may vary and the canister 400*a* and the bearing sleeve 806 may be made of materials with different rates of thermal expansion, then the size or extent of the clearance between the canister 400*a* and the bearing sleeve 806 will change. The O-rings 34 are not intended to seal, but the compression of the O-rings 34 will accommodate this clearance change and will maintain a concentric relationship between the canister 400*a* and the bearing sleeve 806. In this manner, the bearing sleeve 806 provides the canister assembly 400 with a radial bearing surface for rotational engagement with the bushing 800 of the rotor assembly 700.

The outer surface 810 of the stationary bearing sleeve 806 provides the canister assembly 400 a radial bearing surface at the front portion 404 of the canister 400*a*, which is slightly smaller than an inner wall surface 812 of the bushing 800. The inner wall surface 812 serves as a central cylindrical opening for the rotor assembly, such as impeller assembly 700, and provides a radial bearing surface for the impeller assembly 700. Thus, the rotatable rotor assembly, such as impeller assembly 700, has a bushing 800 having a radial bearing surface 812 that rotates in engagement with and is supported by the outer surface 810 of the stationary bearing sleeve 806 of the canister assembly 400.

The canister assembly 400 of pump 2 of this first example embodiment also includes a stationary rear thrust washer 814 having a central opening 816 with a shape that is not cylindrical. The canister 400*a* includes a center portion 416 having a non-cylindrical shape that corresponds to the shape of the central opening 816 of the rear thrust washer 814, to prevent relative rotation between the canister 400 and rear thrust washer 814, although suitable alternative ways of preventing relative rotation may be utilized. The canister 400*a* includes a center wall 418 that has a front surface 420. The rear thrust washer 814 is positioned over the canister center portion 416 and against the front surface 420 of the canister center wall 418.

The canister assembly 400 of pump 2 further includes a stationary front thrust washer 818 with a central opening 820 having a shape that is not cylindrical. The nose cap 500 includes a center portion 508 having a non-cylindrical shape that corresponds to the shape of the central opening 820 of the front thrust washer 818 to prevent relative rotation between the nose cap 500 and front thrust washer 818, although suitable alternative ways of preventing relative rotation between the components of the canister assembly 400 may be utilized. The nose cap 500 has a front surface 509 that includes a front flange 510. The front flange 510 also has a rear surface 512. The front thrust washer 818 is positioned over the center portion 508 of the nose cap 500 and against the rear surface 512 of the front flange 510 of the nose cap 500.

It will be appreciated that while the bearing sleeve 806 provides the canister assembly 400 a radial bearing surface 810, the front thrust washer 818 has a rear surface 828 that provides the canister assembly 400 a first or front axial bearing surface and the rear thrust washer 814 has a front surface 826 that provides the canister assembly 400 a second or rear axial bearing surface, these bearing surfaces alternatively could be integral with the front portion 404 of the canister assembly 400.

The bushing 800 of the rotor assembly or impeller assembly 700 has a length that is slightly shorter than the length of the bearing sleeve 806 of the canister assembly 400. The bearing sleeve 806 is positioned between the rear thrust washer 814 and the front thrust washer 818 of the canister assembly 400, creating a gap equal to the length of the bearing sleeve 806. The impeller assembly 700 is positioned such that the bushing 800 is in the gap between the rear thrust washer 814 and the front thrust washer 818. The bushing 800 also has a front surface 822 and a rear surface 824. The front surface 822 provides the impeller assembly 700 a first or front axial bearing surface. Similarly, the rear surface 824 provides the impeller assembly 700 a second or rear axial bearing surface. Thus, the pump 2 includes a rotatable rotor assembly 700 that includes a bushing 800 wherein the bushing 800 is of single piece construction and includes a radial bearing surface 812 that restricts radial motion of the rotor assembly, a front axial bearing surface 822 that restricts forward motion of the rotor assembly 700, and a rear axial bearing surface 824 that restricts rearward motion of the rotor assembly 700.

Under some pump operating conditions, the impeller assembly 700 may experience a rear thrust force, pushing the impeller assembly 700 rearward and causing the rear surface 824 of the bushing 800 to rotatably engage the front surface 826 of the rear thrust washer 814. Under other pump operating conditions, the impeller assembly 700 may experience a forward thrust force, pushing the impeller assembly 700 forward and causing the front surface 822 of the bushing 800 to rotatably engage the rear surface 828 of the front thrust washer 818. The bushing 800 also includes one or more grooves 830 on the front face 822, rear face 824 and inner surface 812, which are connected. The radial bearing surface 812 of the rotor assembly 700 and the radial bearing surface 810 of the canister assembly front portion restrict radial motion of the rotor assembly 700, and the first axial bearing surface 822 of the rotor assembly 700 and the first axial bearing surface 828 of the canister assembly front portion 404 restrict forward motion of the rotor assembly 700. In addition, the rotor assembly 700 further comprises a second axial bearing surface 824, the canister assembly front portion further comprises a second axial bearing surface 826, and the second axial bearing surface of the rotor assembly 824 and the second axial bearing surface 826 of the canister assembly front portion 404 restrict rearward motion of the rotor assembly 700.

The canister 400*a* includes a thin cylindrical portion 422 having an inner surface 424 that is slightly larger than the outer surface 652 of the inner magnet assembly 600, and having an outer surface 426 that is slightly smaller than the inner surface 738 along the thin cylindrical portion 714 of the impeller magnet sleeve 712. The casing 100, backplate 200, and canister assembly 400, with its canister 400*a* and nose cap 500, all remain stationary, are sealingly connected, and together form a sealed fluid chamber rearward of the canister assembly 400.

The magnet segments 646 of the drive magnet assembly or inner magnet assembly 600 are in axial alignment with the magnet segments 710 of the outer magnet assembly 705 of the rotatable rotor assembly or impeller assembly 700. The stationary cylindrical portion 422 of the canister assembly 400 is located in a radial gap between the magnet segments 646 of the inner magnet assembly 600 and the magnet segments 710 of the outer magnet assembly 705 of the rotor assembly 700. The alternating polarity of the magnet segments 646 creates an inner magnetic field, and the alternating polarity of the magnet segments 710 creates an outer magnetic field. These two magnetic fields synchronize together to provide a strong magnetic coupling torque between the inner magnet assembly 600 and the impeller assembly 700, such that when the motor 6 is energized, it rotates the motor shaft 22, which rotates the inner magnet assembly 600, which in turn, rotates the impeller assembly 700.

Figure 5:
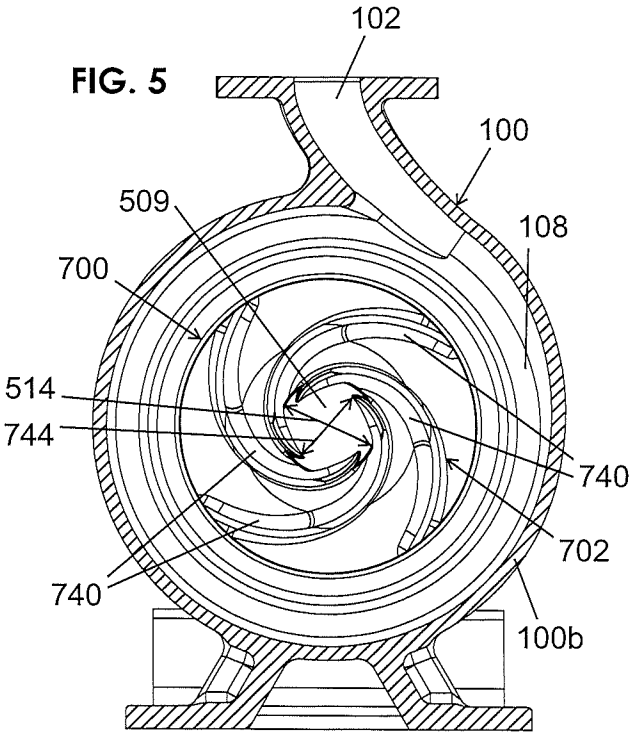
FIG. 5 provides a front view of the first example pump of FIG. 1 with a sectioned front portion of the casing.
Figure 4:
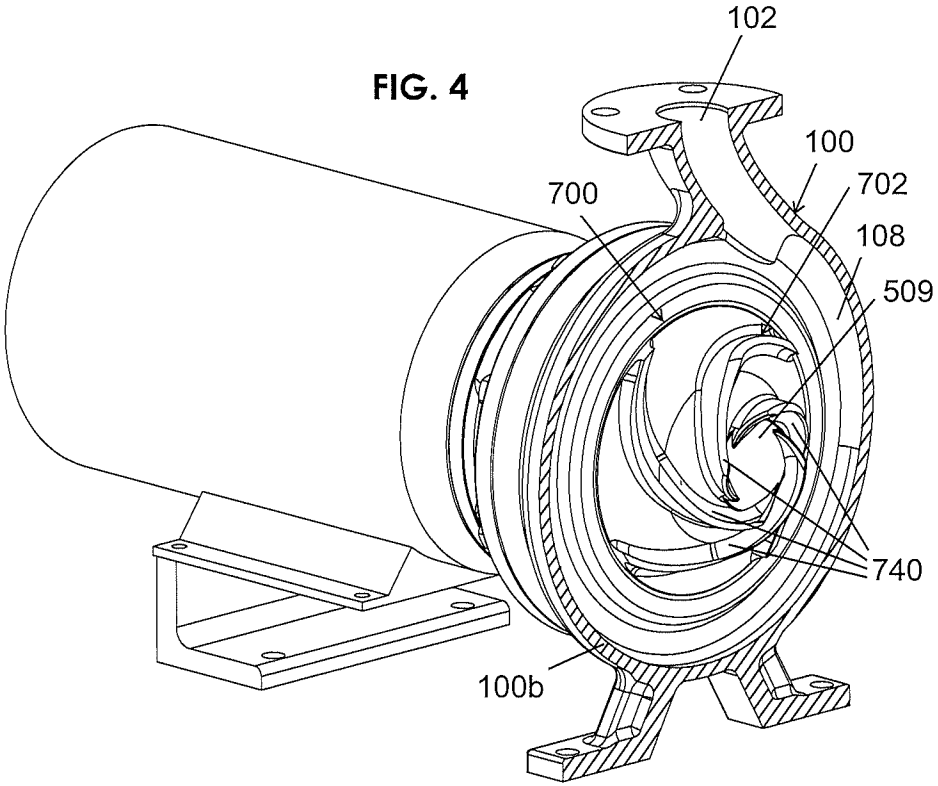
FIG. 4 provides a perspective view of the first example pump of FIG. 1 with a sectioned front portion of the casing.

Referring to FIGS. 4 and 5, the impeller 702 includes a plurality of vanes 740. The casing 100 includes a discharge collector cavity 108 that is fluidly connected to the casing discharge port 102. The rotation of the impeller vanes 740 causes a pumping action that moves liquid into the pump through the casing inlet port 104, radially outward to the discharge collector cavity 108, and out of the pump through the discharge port 102. A portion of the vanes 740 of the rotor or impeller 702 extend forward in front of the front surface 509 of the nose cap 500 and inward to an inner diameter 744 that is smaller than an outer diameter 514 of the nose cap 500 of the canister assembly 400.

Figure 3:
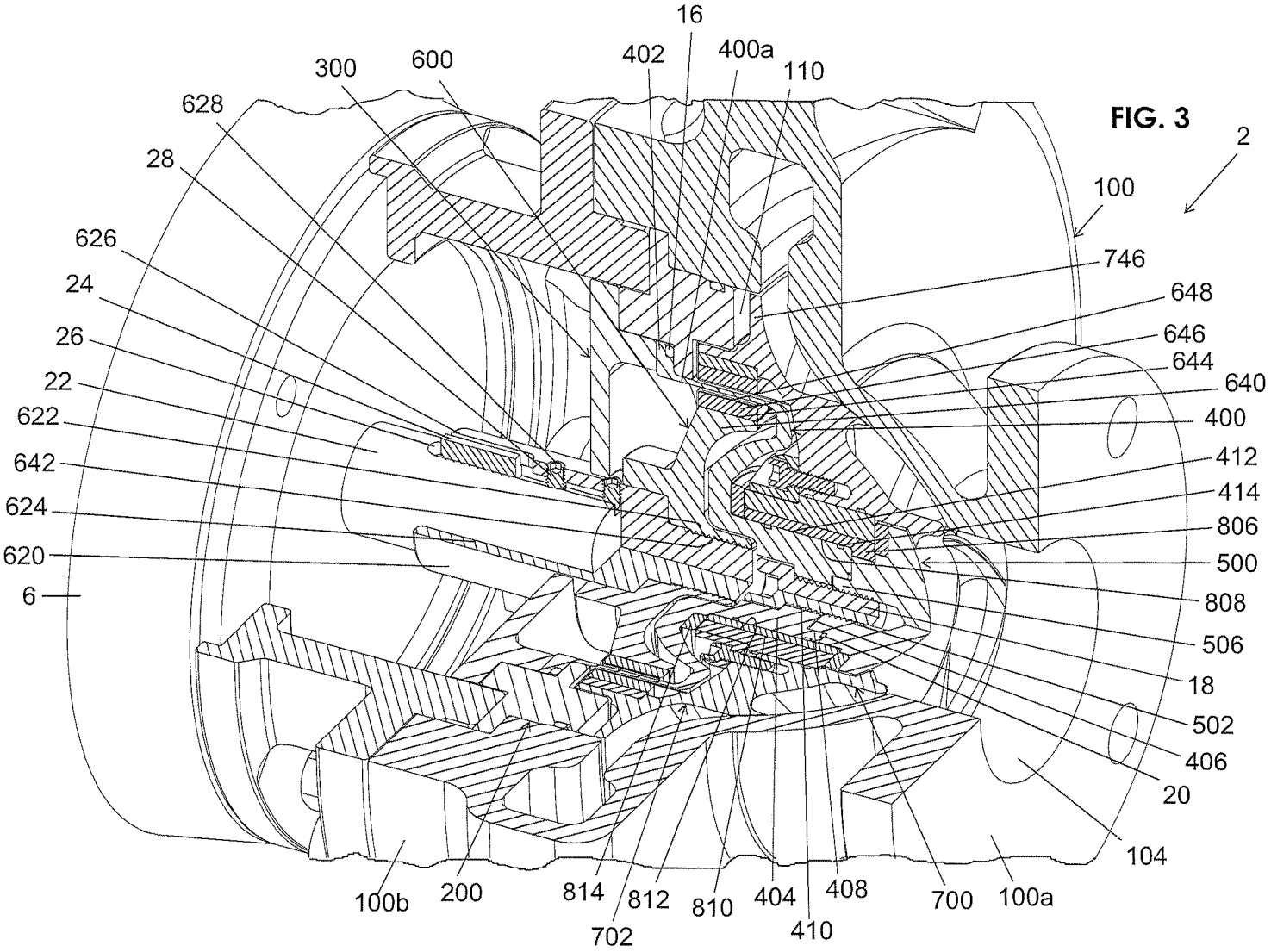
FIG. 3 provides an enlarged closer perspective view of the quarter-sectioned area of FIG. 2.

Referring to FIG. 6*a*, the impeller 702 includes a rear wall 746 having a plurality of optional rear vanes 748. As seen in FIG. 3, the casing 100 includes a rear cavity 110 that is partially blocked from the discharge collector cavity 108 by the impeller rear wall 746. During pump operation, rotation of the impeller 702 rotates the fluid within the rear cavity 110. The optional rear vanes 748 enhance or increase the speed of rotation of the fluid within the rear cavity 110 of the casing 100 which experiences centrifugal force. The centrifugal force will tend to create a radial pressure gradient in the rear cavity 110, where the pressure is somewhat proportional to the radius. This gradient will partially resist the pressure differential that promotes the recirculation path P, and will reduce the overall pressure within the rear cavity 110, to that the net forward thrust on the rotor assembly or impeller assembly 700 is reduced.

When pump 2 is operating, the pumping action of the impeller vanes 740 creates a pressure differential within the pump 2, such that the pressure at the inlet port 104 and in front of the nose cap 500 at the suction end of the pump 2 is lower than the pressure in the discharge collector cavity 108 and at the discharge port 102.

Figure 10:
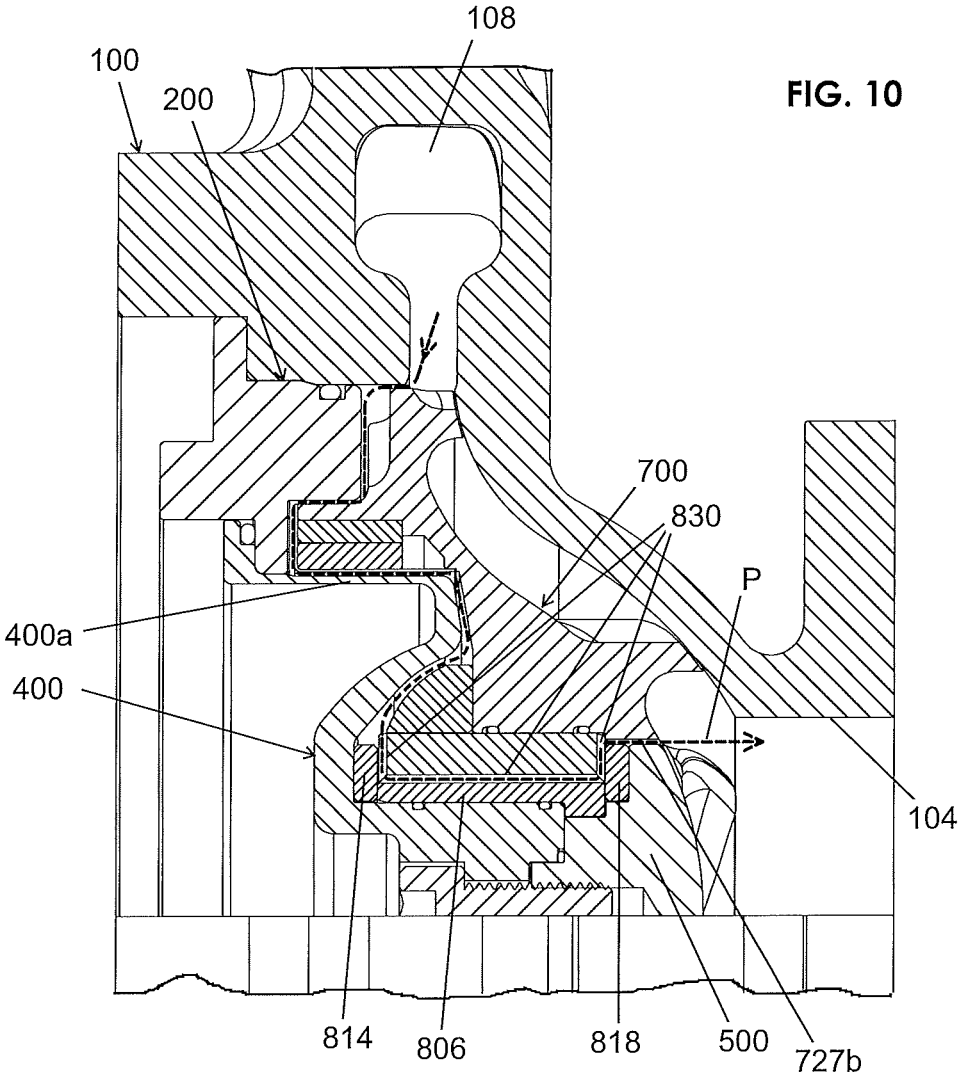
FIG. 10 provides a portion of a quarter-sectioned plan view of the first example pump of FIG. 1 showing a recirculation path and without the power end drive components.

As may be seen in FIG. 10 in a simplified view of the pump 2 without the drive magnet assembly or inner magnet assembly 600 and the power end drive components, the pump 2 includes a rather complex recirculation path P behind the impeller assembly 700. The recirculation path P begins at the discharge collector cavity 108, where the pressure is high, extends between stationary and rotating surfaces, and ends in front of the nose cap 500, where the pressure is low. The recirculation path P is uniquely dynamic, because every portion of the path is bounded by a combination of a stationary surface and a rotating surface. This helps to avoid stagnation and clogging of the recirculation path P, which is used for lubrication and cooling of the pump components, such as the bushings and the canister assembly. The stationary surfaces are on the casing 100, backplate 200, and components of the canister assembly 400, including the canister 400*a*, rear thrust washer 814, bearing sleeve 806, front thrust washer 818 and nose cap 500. The rotating surfaces are on the rotatable rotor assembly or impeller assembly 700. The recirculation path P includes a radial gap between the canister 400*a* and the sleeve 712 of the rotor assembly or impeller assembly 700. The one or more grooves 830 on the front face 822, rear face 824 and inner surface 812 of the bushing 800 also facilitate fluid passage.

The recirculation path P includes flow from the discharge collector cavity 108 past the outer edge of the impeller 702. The fluid moves radially inward behind the impeller 702 and then further rearward behind the outer magnet assembly 705. The fluid then moves forward along the canister portion extending through the radial gap between the canister and the outer magnet assembly 705, and then the fluid passes radially inward over the canister to the bushing 800. The fluid then passes through the grooves 830 that extend across the rear surface, inner surface and front surface of the bushing 800. This example pump 2 includes four grooves 830 in the bushing 800, and as a result, the fluid splits into four separate streams corresponding to the four grooves 830. The four parallel paths continue through the grooves 830 to the front surface of the bushing 800. The four flow paths come together at the front surface of the bushing 800 and then the fluid passes through a gap formed by the inner surface 727*b* of the impeller and both the outer surface of the front thrust washer 818 and the outer edges of the nose cap 500, and to the low pressure area proximate the inlet port 104.

Figure 11:
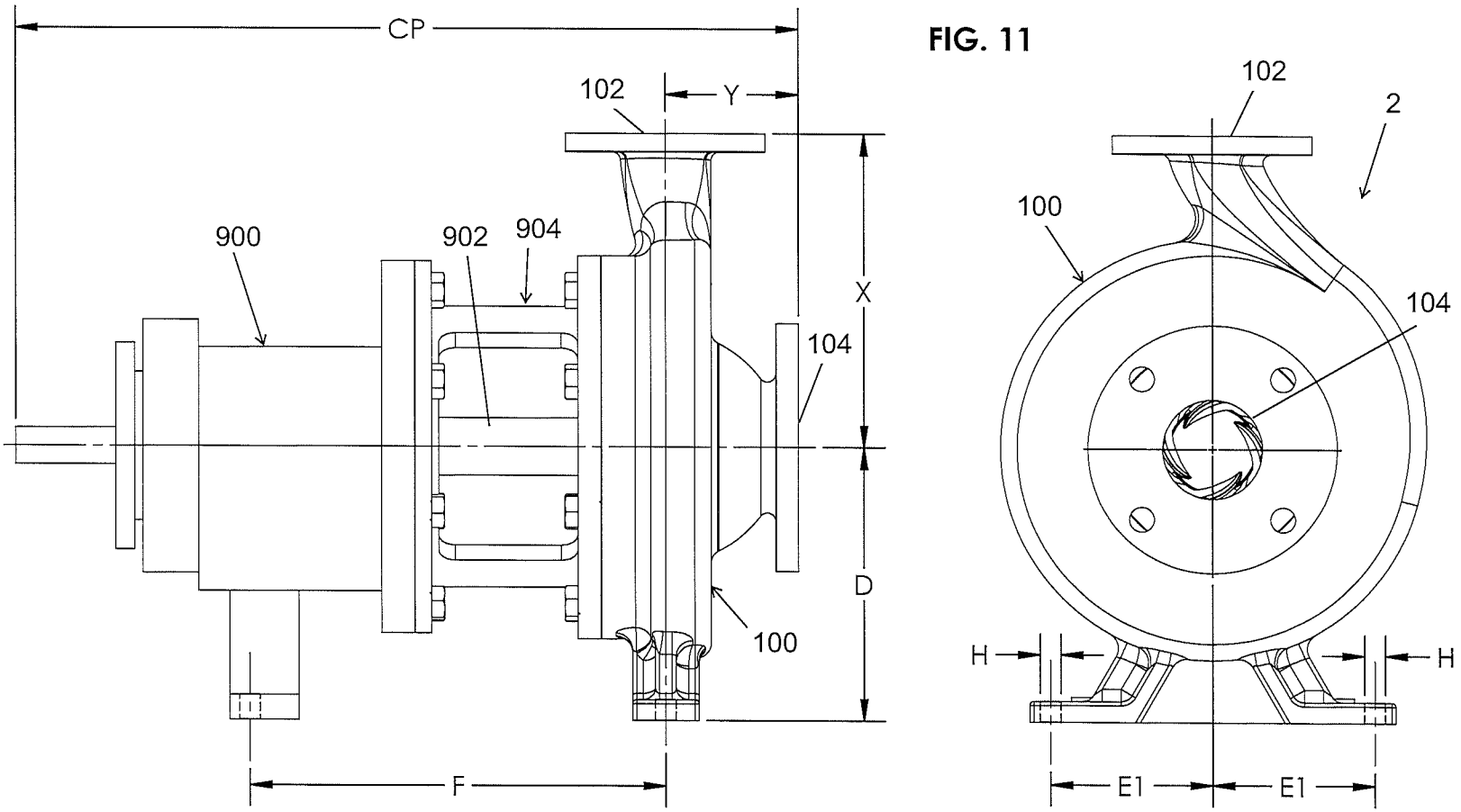
FIG. 11 provides a side view and a front view of a second example pump connected to a power end that is suitable for another pump meeting ASME B73.1 or ISO 5199 dimensional standards.
Figure 12:
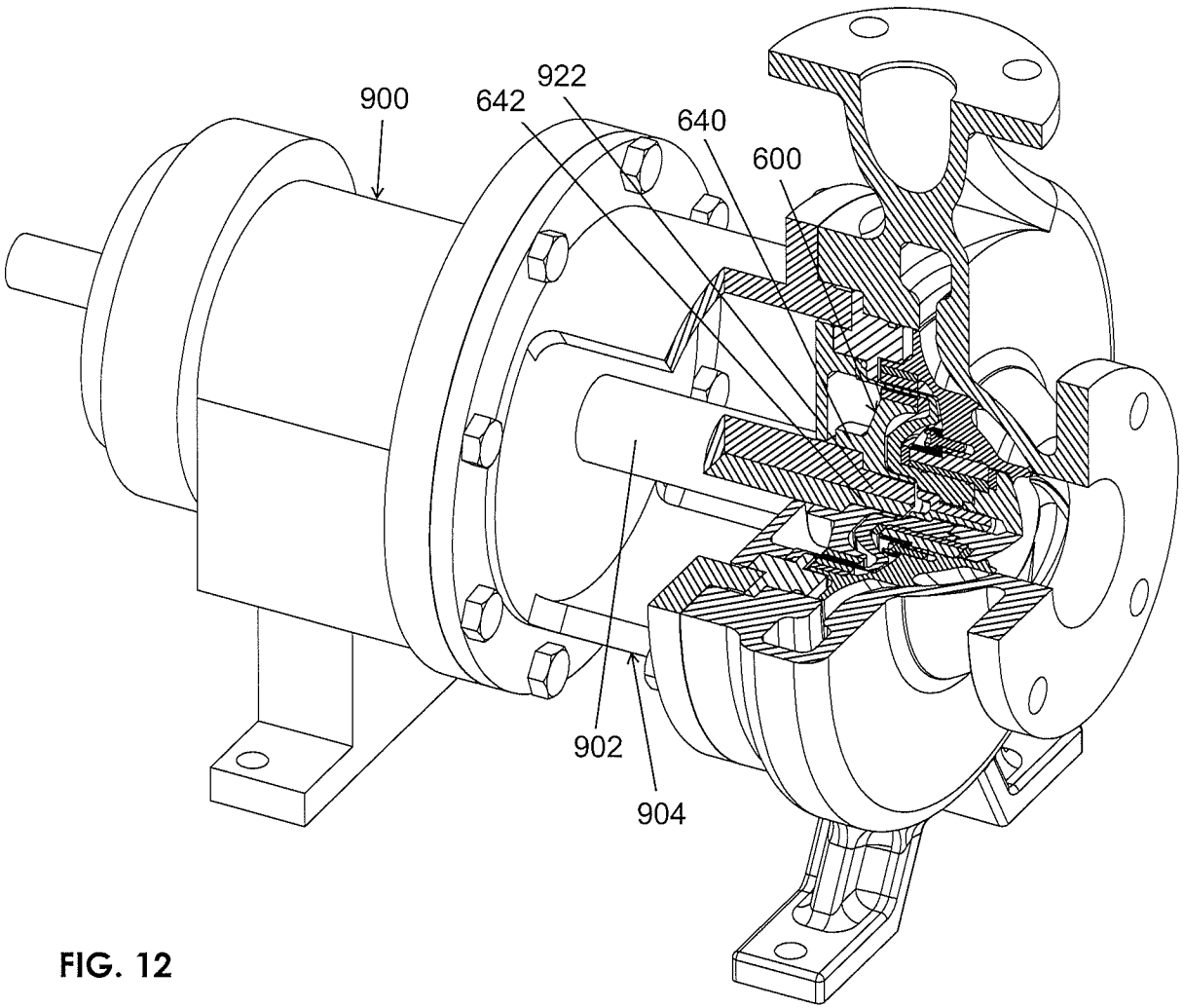
FIG. 12 provides a quarter-sectioned perspective view of the second example pump of FIG. 11.
Figure 13:
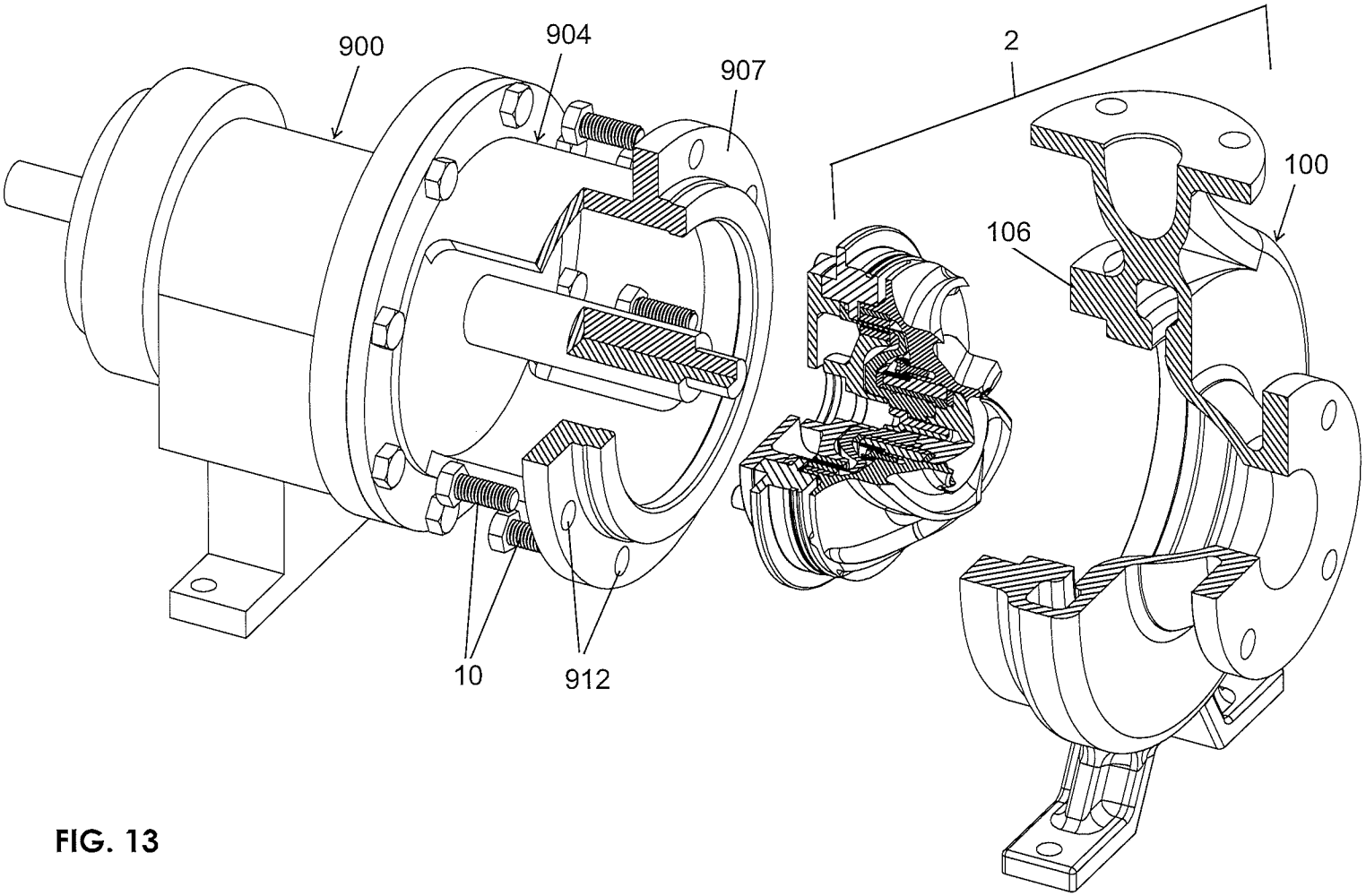
FIG. 13 provides a quarter-sectioned perspective partially exploded view of the second example pump of FIG. 11.
Figure 14:
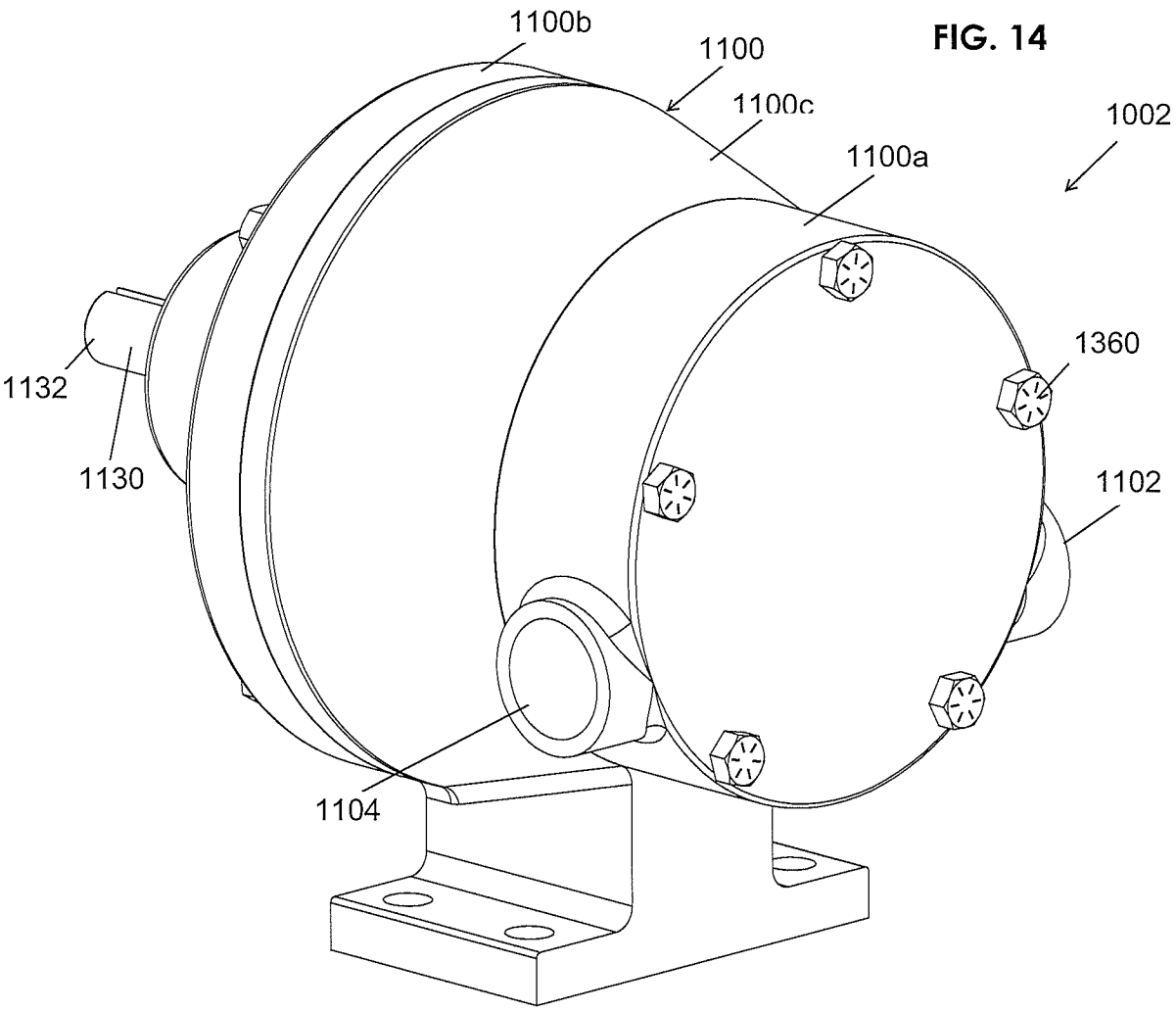
FIG. 14 provides a front perspective view of a third example pump.
Figure 15:
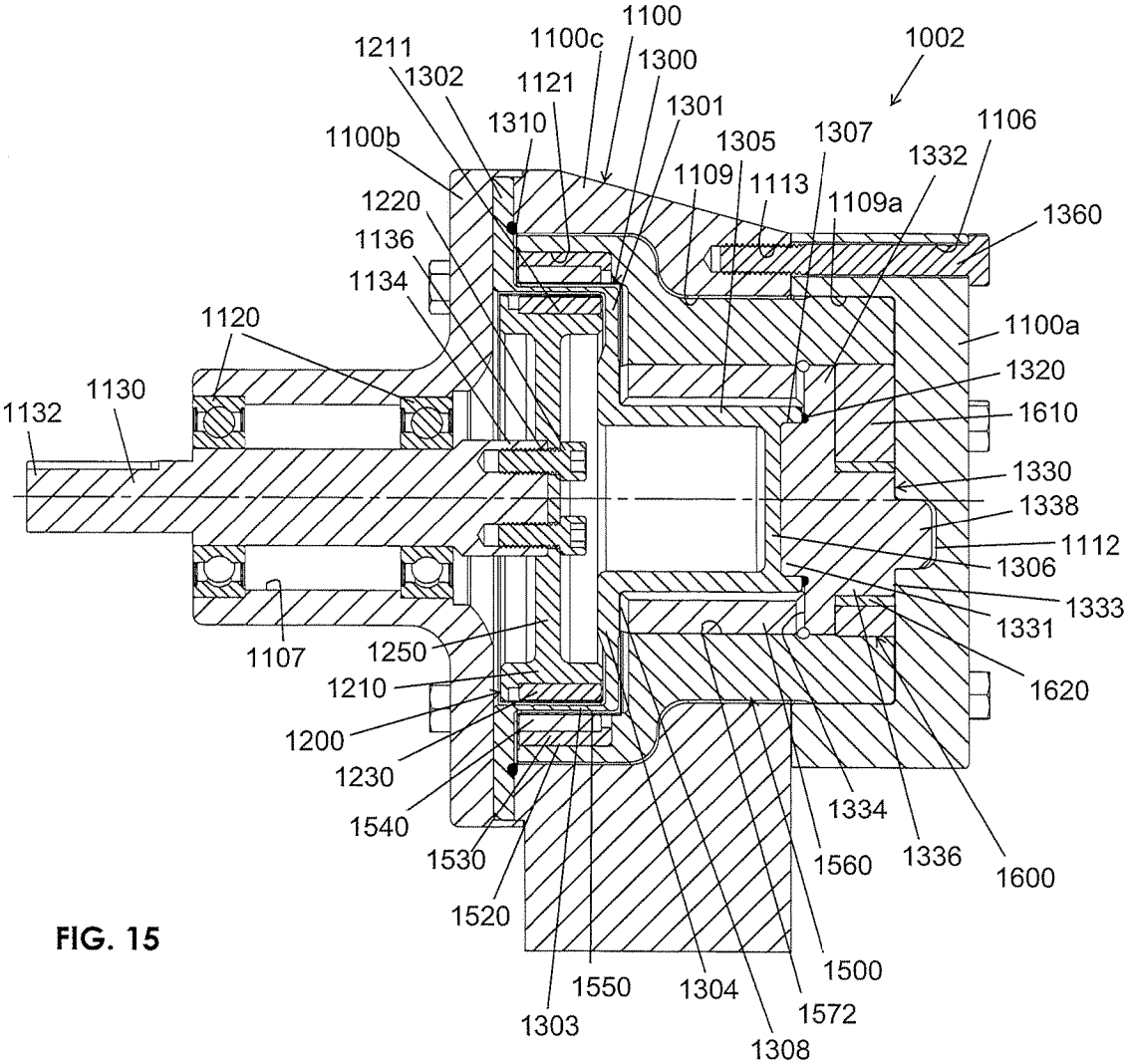
FIG. 15 provides a cross-sectioned view of the third example pump of FIG. 14.
Figure 16:
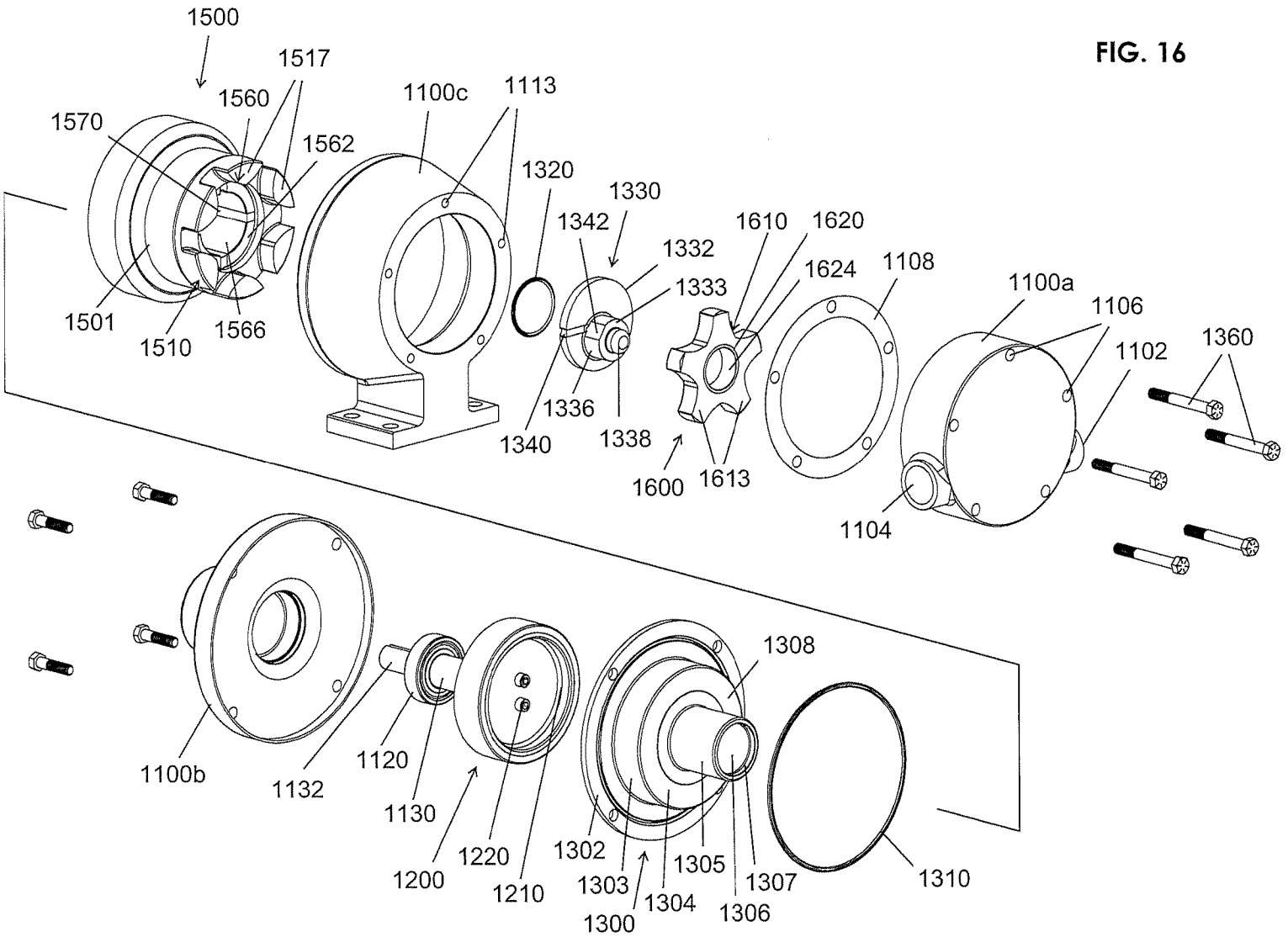
FIG. 16 provides a front perspective partially exploded view of the third example pump of FIG. 14.
Figure 17:
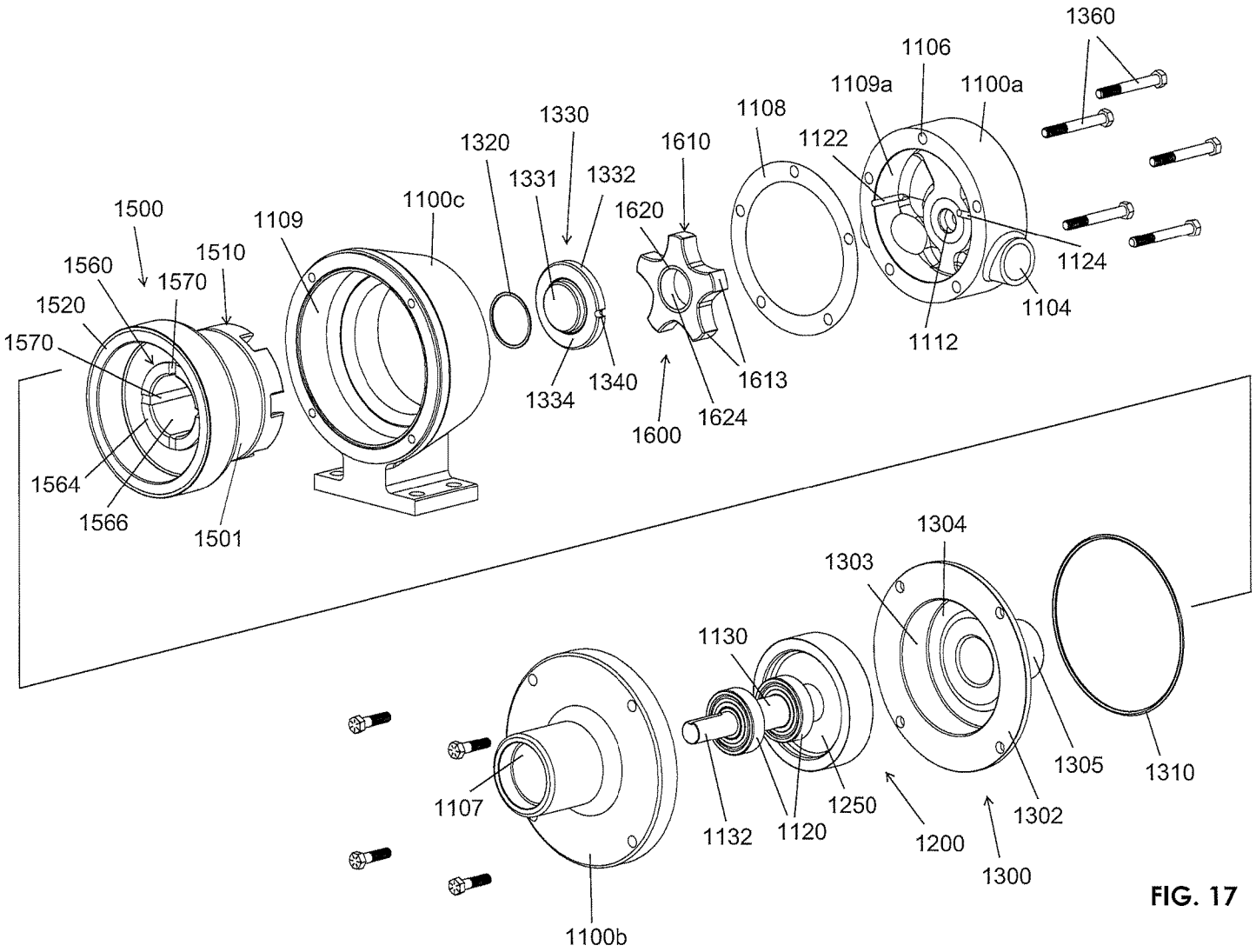
FIG. 17 provides a rear perspective partially exploded view of the third example pump of FIG. 14.
Figure 18:
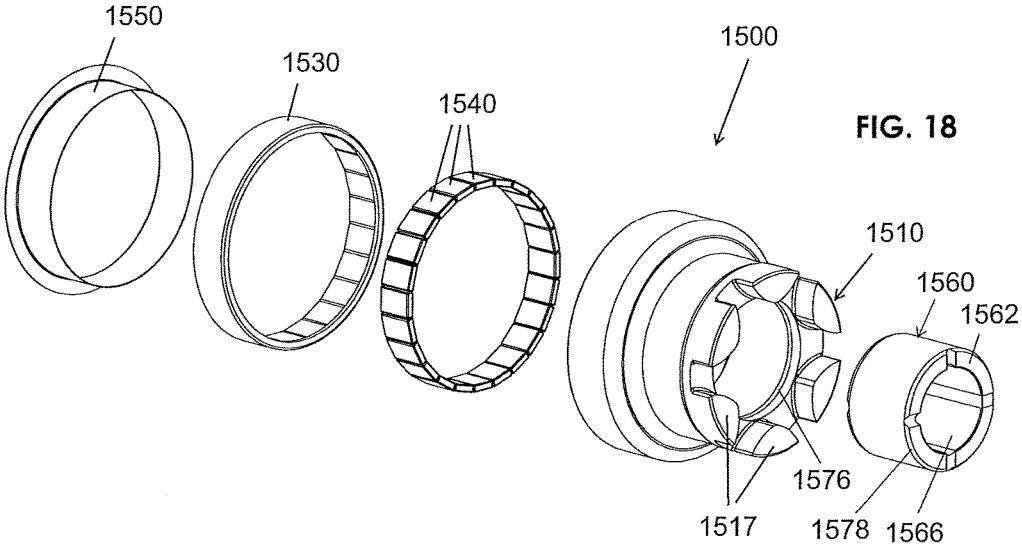
FIG. 18 provides a front perspective exploded view of the rotor assembly of the third example pump of FIG. 14.
Figure 19:
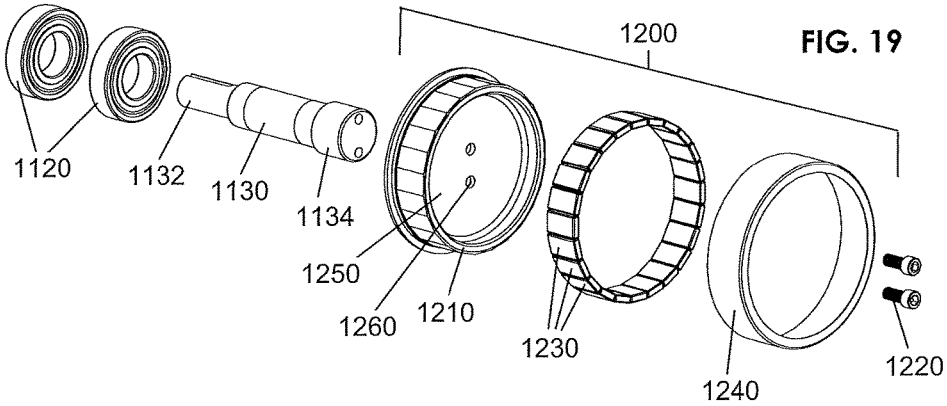
FIG. 19 provides a front perspective exploded view of the drive magnet assembly of the third example pump of FIG. 14.
Figure 20:
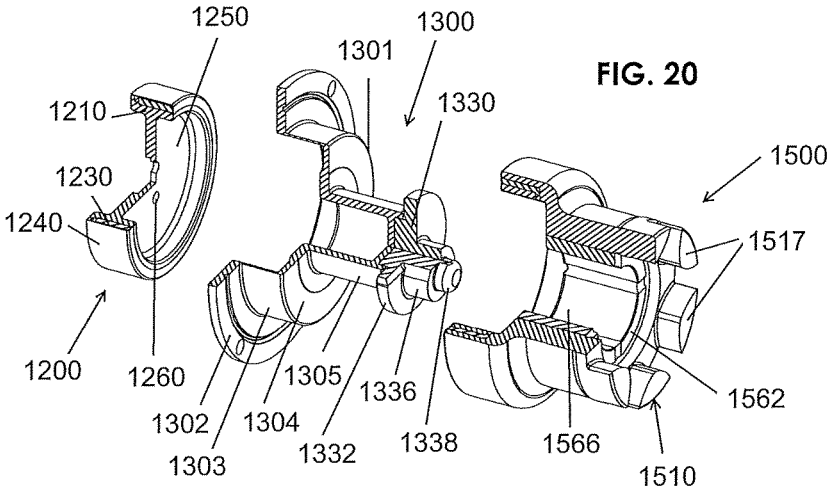
FIG. 20 provides a quarter-sectioned perspective partially exploded view of the drive magnet assembly, canister and rotor assembly of the third example pump of FIG. 14.
Figure 21:
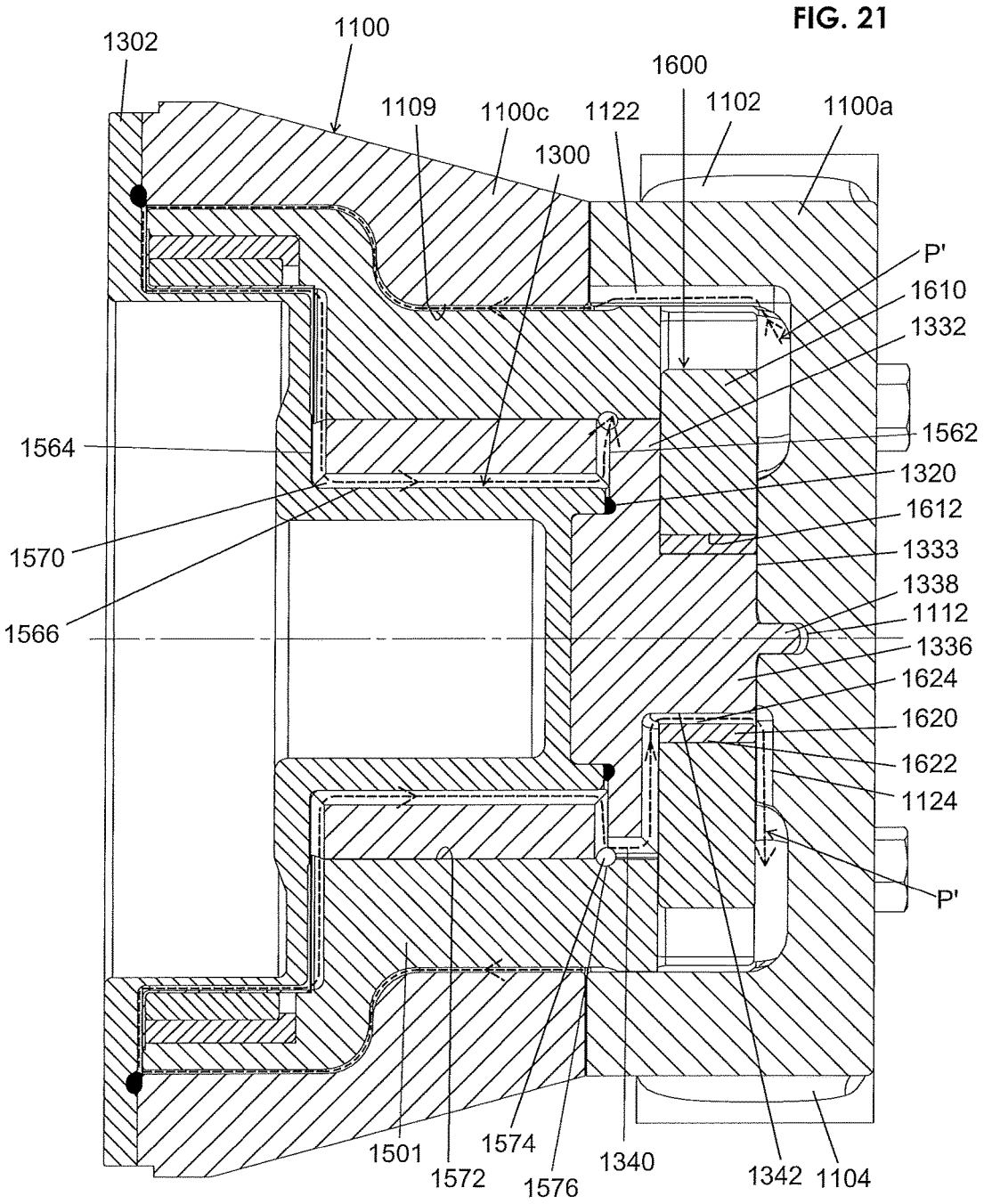
FIG. 21 provides a portion of a quarter-sectioned plan view of the pump of FIG. 14 showing a recirculation path and without the power end drive components.

Referring to FIGS. 11-13, the same pump 2 of the first example is shown in a second example but connected to a different a rear end mechanical drive portion or power end and an adaptor. In this second example, the pump 2 is connected to a power end 900 and adapter 904 of a commercially available non-magnetically driven rotodynamic pump having a dynamic seal that is designed in accordance with dimensions specified in a pump industry standard, such as, for example, a Goulds 3196 Pump, made by ITT Goulds Pumps of Seneca Falls, N.Y., which is designed to meet the dimensioned required in industry standard ASME B73.1. This also applies to industry standard ISO 5199. The casing 100 is configured to be mounted in a stationary position and includes a rear face 106 that is connected to a flange 907 of the adapter 904 by use of a plurality of fasteners 10 that pass through apertures 912 in the flange 907 and engage threaded holes in the casing rear face 106.

In this second example, however, the pump 2 further includes an inner magnet assembly 600 that includes an inner ring 640 which is connected directly to a shaft 902 of the power end 900. The inner ring 640 has a central threaded aperture 642 and the power end shaft 902 has a mating externally threaded front portion 922, which is used to connect the inner ring 640 to the power end shaft 902. Thus, the example magnetically driven pump 2 can be substituted in place for a dynamically sealed pump and will provide or accommodate the same mounting dimensions that are shown in FIG. 11 as including: the horizontal distance F between the front and rear mounting feet; the vertical distance D from the bottom of the front mounting feet to the center of the motor shaft 902 and center of the flange for the inlet port 104 at the front of the pump 2; the vertical distance X from the center of the motor shaft 902 and center of the flange for the inlet port 104 at the front of the pump 2 to the top surface of the flange for the discharge port 102; the horizontal distance from the center of the discharge port 102 to the front of the flange for the inlet port 104; the horizontal distances E1 from the center of the inlet port 104 to the center of the mounting holes of the front mounting feet; the diameter H of the mounting holes in the front mounting feet; and the overall length CP of the pump 2 and power end.

Turning to FIGS. 14-21, a third example pump 1002 is shown. The third example pump 1002 happens to be a magnetically driven, positive-displacement gear pump. The third example pump 1002 includes a casing 1100 that includes a front portion 1100*a* and a rear portion 1100*b* and a central portion 1100*c*. The casing portions may be separate components that are connected together or portions may be formed integrally, such as by casting. The casing 1100 is configured to be mounted in a stationary position via mounting feet on the central portion 1100*c*. The casing 1100 also has a discharge port 1102 and an inlet port 1104. In this third example, the discharge port 1102 and inlet port 1104 both are radially facing, although alternative configurations may be utilized. The casing 1100 may be constructed of rigid materials, such as steel, stainless steel, cast iron or other metallic materials, or structural plastics or the like.

The rear portion 1100*b* of the casing 1100 includes an opening 1107 that receives one or more bushings or bearings 1120, shown in the present example in the form of bearings. Also within the rear portion 1100*b* is a shaft 1130. The shaft 1130 has a drive end 1132 that may be coupled to a driver (not shown), such as an electric motor or the like, that causes the shaft 1130 to rotate. As such, the example shaft 1130 is supported by the bushings or bearings 1120 and is free to rotate within the opening 1107 of the rear portion 1100*b* of the casing 1100.

The shaft 1130 may be constructed of rigid materials, such as steel, stainless steel, cast iron or other metallic materials, or structural plastics or the like. The shaft 1130 also may have a magnet receiving end 1134 that may include one or more holes 1136, which in this example are threaded, but it will be understood that other configurations may be used for connecting components to the magnet receiving end 1134.

An example rotatable drive magnet assembly or inner magnet assembly 1200 is attached to the magnet receiving end 1134 of the shaft 1130. The inner magnet assembly 1200 may include an inner ring 1210 having a generally cylindrical shape, one or more fasteners 1220 for connection to the receiving end 1134, a plurality of (two or more) inner magnet segments 1230 and an optional inner magnet sleeve 1240. The optional inner magnet sleeve 1240 may provide additional attachment force to hold the inner magnet segments 1230 to an outer surface 1211 of the inner ring 1210 and may provide protection of the inner magnet segments 1230 from corrosion or damage. The inner magnet sleeve 1240 may be constructed of rigid materials, but preferably is constructed of a material with very low magnetic permeability, such as stainless steel or the like. The method of connection for the inner magnet segments 1230 may be via adhesive, mechanical fasteners or other suitable means of connection. The magnet segments 1230 are radially charged and are positioned with alternating polarity, so as to create a magnetic field directed radially outward.

The example inner ring 1210 may have a web 1250 that in this example engages the magnet receiving end 1134 of the shaft 1130, and one or more holes 1260 that align with holes 1136 in the magnet receiving end 1134 of the shaft 1130 and receive the fasteners 1220. In the present example, the inner ring 1210 may be connected to and rotate with the magnet receiving end 1134 of the shaft 1130. The inner ring 1210 may be constructed of rigid materials, but is preferably constructed of a material with high magnetic permeability, such as iron, carbon steel or the like. It also will be understood that the inner ring 1210 may be connected to the shaft 1130 in alternative ways.

The casing 1100 includes an opening 1109, which in this example is in the central portion 1100*c*. The opening 1109 receives a canister assembly 1300 that is intended to be stationary. The canister assembly 1300 may be constructed of multiple pieces or may be of an integral, one-piece construction. The canister assembly 1300 may be constructed of rigid materials. It will be appreciated that common materials may be used, such as stainless steel, or low conductivity metals, such as alloy C-22 or alloy C-276, and it could be advantageous to use materials having very low electrical conductivity, such as silicon carbide, ceramic, polymers or the like. The stationary canister assembly 1300 includes a canister 1301 having a rear flange 1302 that extends radially outward and is held between the connection of the rear portion 1100*b* to the central portion 1100*c* of the casing 1100. A rear canister seal 1310 creates a leak-tight connection between the radial rear flange 1302 of the canister 1301 and the central portion 1100*c* of the casing 1100. The rear canister seal 1310, may be in the form of static seal having a resilient O-ring shape, or a preformed or liquid gasket or the like, and preferably is constructed of an elastomeric material such as rubber or the like.

The canister 1301 of the canister assembly 1300 also includes a first cylindrical portion 1303 extending forward from the rear flange 1302 to a central radially extending portion 1304 that extends outward from the first cylindrical portion 1303 to a second cylindrical portion 1305 that extends further forward and is closed at the forward end by an end wall 1306. The end wall 1306 is set back from the front end of the second cylindrical portion 1305, forming a recess 1307 at the front of the canister 1301.

The canister assembly 1300 also includes a nose cap 1330 having a rear portion 1331 that engages the recess 1307 at the front of the canister 1301. The nose cap 1330 of the canister assembly 1300 also has a flange 1332 that extends radially outward. A rear surface 1334 of the flange 1332 provides a first or forward axial bearing surface of the canister assembly 1300. The central radially extending portion 1304 of the canister 1301 has a front surface 1308 that provides a second or rearward axial bearing surface of the canister assembly 1300. The nose cap 1330 may be constructed of rigid materials, such as steel, stainless steel, cast iron or other metallic materials, or structural plastics or the like. A front canister seal 1320, such as in the form of static seal having a resilient O-ring shape, or a preformed or liquid gasket or the like, creates a leak-tight connection between the canister 1301 and the nose cap 1330, and may be constructed of similar materials to those mentioned with respect to the rear seal 1310. The stationary canister assembly 1300 separates an internal fluid chamber within the pump 1002 from the inner magnet assembly 1200. It also will be appreciated that any of the bearing surfaces of the canister assembly 1300, such as the radial bearing surface provided by the second cylindrical portion 1305, the first or forward axial bearing surface provided by the rear surface 1334 of the flange 1332 of the nose cap 1330, and the second or rearward axial bearing surface provided by the front surface 1308 of the central radially extending portion 1304 of the canister 1301 alternatively could be provided by separate pieces, such as in the first example pump 2.

The front portion 1100*a* of the casing 1100 has a rear face that is sealed by a gasket 1108 to a front face of the central portion 1100*c* and closes the opening 1109 in the central portion 1100*c*. The gasket 1108 may be in the form of a static seal, such as a preformed or liquid gasket or the like, or an O-ring, and creates a leak-tight connection between the front portion 1100*a* and central portion 1100*c*, and may be constructed of similar materials to those mentioned with respect to the other seals. In this example, the front portion 1100*a* also has an inner surface 1109*a* that generally is aligned with the opening 1109 of the central portion 1100*c* of the casing 1100. The front portion 1100*a* may be constructed of rigid materials, such as steel, stainless steel, cast iron or other metallic materials, or structural plastics or the like.

The front end of the central portion 1100*c* has one or more holes 1113, which in this example are threaded. The front portion 1100*a* is connected to the central portion 1100*c* by one or more fasteners 1360. In the present example, an elongated shaft portion of the one or more fasteners 1360, which in this example is threaded, is assembled through one or more holes 1106 in the front portion 1100*a* and is installed in the one or more holes 1113 in the front of the central portion 1100*c* of the casing 1100. It also will be understood that the front portion 1100*a* may be connected to other portions of the casing 1100 in alternative ways.

The nose cap 1330 of the canister assembly 1300 includes a front face 1333 that engages the front portion 1100*a*. The nose cap 1330 also includes a front gear support extension 1336, from which a further nose cap support extension 1338 extends. At least a portion of the nose cap support extension 1338 is received by an opening 1112 in the front portion 1100*a*. The front nose cap support extension 1338 of the canister nose cap 1330 may include an alignment surface or shape that engages with a complementary surface or shape within the front portion 1100*a*, such that when the nose cap support extension 1338 is received in the opening 1112 of the front portion 1100*a*, the canister assembly 1300 is supported at its front end by the front portion 1100*a* of the casing 1100 and the engagement of the alignment surface or shape prevents relative rotation between nose cap 1330 and the front portion 1100*a*. It will be understood that alternative methods and configurations may be used to prevent relative rotation between the respective components, so that the canister assembly 1300 remains stationary. Although not required, an optional seal, such as in the form of static seal having a resilient O-ring shape, or a preformed or liquid gasket or the like, may be located between the nose cap front portion 1100*a* to prevent pumped fluids from entering the opening 1112 in the front portion 1100*a*. Such a seal may be constructed of similar materials to those mentioned with respect to the other seals.

A rotatable rotor assembly or outer gear assembly 1500 includes a rotor 1501 having an outer gear 1510 at a forward end and an opening 1520 at the rearward end that receives an outer ring 1530, a plurality of (two or more) outer magnet segments 1540, and an optional inner magnet sleeve 1550. In this way, the rotor assembly 1500 includes a rear opening 1520 having an inner wall surface 1521 to which a plurality of magnet segments 1540 is connected. The rotor 1501 may be constructed of rigid materials, such as steel, stainless steel, cast iron or other metallic materials, or structural plastics or the like. The outer ring 1530 may be constructed of rigid materials, but preferably is constructed of a material with high magnetic permeability, such as iron, carbon steel or the like. The outer ring 1530 is connected in the opening 1520, which may be accomplished by various means, including by interference fit, adhesive, welding, the use of fasteners or the like.

The outer ring 1530 includes an inner surface to which a plurality of (two or more) outer magnet segments 1540 are connected. It will be appreciated that the quantity of outer magnet segments 1540 should be equal to the quantity of the inner magnet segments 1230 that are connected to the inner ring 1210. The method of connection for the outer magnet segments 1540 may be via adhesive (preferred), mechanical fasteners or other suitable means of connection. The outer magnet segments 1540 are magnetically radially charged and are positioned with alternating polarity, so as to create a magnetic field directed radially inward. The optional inner magnet sleeve 1550 may provide additional attachment force to hold the outer magnet segments 1540 to the outer ring 1530 and may provide protection of the outer magnet segments 1540 from corrosion or damage.

The stationary first cylindrical portion 1303 of the canister assembly 1300 is located in a radial gap between the magnet segments 1230 of the inner magnet assembly 1200 and the magnet segments 1540 of the rotatable rotor assembly or outer magnet assembly 1500. The magnet segments 1230 of the inner magnet assembly 1200 also are in axial alignment with the magnet segments 1540 of the rotor assembly or outer magnet assembly 1500. The stationary first cylindrical portion 1303 of the canister assembly 1300 is located in a radial gap between the magnet segments 1230 of the inner magnet assembly 1200 and the magnet segments 1540 of the outer magnet assembly of the rotor assembly 1500. The alternating polarity of the magnet segments 1230 creates an inner magnetic field, and the alternating polarity of the magnet segments 1540 creates an outer magnetic field. These two magnetic fields synchronize together to provide a strong magnetic coupling torque between the inner magnet assembly 1200 and the rotating rotor assembly 1500. In addition, the canister assembly 1300 includes a front portion extending from the first cylindrical portion, which in this example also includes a second cylindrical portion 1305 which essentially extends from the first cylindrical portion and includes a radial bearing surface, as well as a nose cap 1330, which includes a first axial bearing surface 1334 on the rear of the flange 1332.

The rotatable rotor assembly 1500 is positioned within the central portion 1100*c* and front portion 1100*a* of the casing 1100 and includes a rotor bushing 1560. The rotor 1501 having the outer gear 1510 may be constructed of rigid materials, such as steel, stainless steel, cast iron or other metallic materials, or structural plastics or the like. The rotor bushing 1560 includes a front surface 1562 that provides a first or forward axial bearing surface and a rear surface 1564 that provides a second or rearward axial bearing surface. The rotor bushing 1560 further includes an inner wall surface 1566 that serves as a central cylindrical opening for the rotor assembly 1500 and provides a radial bearing surface for the rotor assembly 1500.

The inner surface 1566 of the bushing 1560 of the rotor assembly or outer gear assembly 1500 provides a radial bearing surface that slidingly rotates on and is supported by the second cylindrical portion 1305 of the canister 1301 of the canister assembly 1300. The first or forward axial bearing surface provided by the front surface 1562 of the bushing 1560 slidingly rotates against or engages the first or forward axial bearing surface provided by the rear surface 1334 of the flange 1332 of the canister assembly 1300. The second or rearward axial bearing surface provided by the rear surface 1564 of the bushing 1560 slidingly rotates against or engages the second or rearward axial bearing surface provided by the front surface 1308 of the central radially extending portion 1304 of the canister 1301 of the canister assembly 1300. Thus, the bushing 1560 is of single piece construction and provides all of the bearing surfaces for the rotor assembly 1500.

Indeed, the radial bearing surface 1566 of the rotatable rotor assembly 1500 and the radial bearing surface provided by the outer surface of the second cylindrical portion 1305 of the canister assembly front portion restrict radial motion of the rotor assembly 1500, and the first axial bearing surface 1562 of the rotor assembly 1500 and the first axial bearing surface 1334 of the nose cap 1330 restrict forward motion of the rotor assembly 1500. In addition, the rotor assembly 1500 further comprises a second axial bearing surface 1564, the canister assembly front portion further comprises a second axial bearing surface 1308, and the second axial bearing surface of the rotor assembly 1564 and the second axial bearing surface 1308 of the front portion of the canister assembly 1300 restrict rearward motion of the rotor assembly 1500.

A rotatable drive magnet assembly or inner gear assembly 1600 includes inner gear 1610 that is positioned within the front portion 1100*a* of the casing 1100. The inner gear 1610 may be constructed of rigid materials, such as steel, stainless steel, cast iron or other metallic materials, or structural plastics or the like. Although not required, the inner gear assembly 1600 also may include an optional inner gear bushing 1620, which has an outer surface 1622 that may be connected to an inner surface 1612 of the inner gear 1610 by various means, including by interference fit, adhesive, welding, the use of fasteners or the like. The inner gear bushing 1620 also has an inner surface 1624 that provides a radial bearing surface for the inner gear 1610 as it slidingly rotates on the front gear support extension 1336 of the nose cap 1330 of the canister assembly 1300.

Pump operation comes from rotational energy that is supplied by a driver (not shown), such as an electric motor or the like, that is connected to the drive end drive end 1132 of the shaft 1130. Thus, rotation of a driver or motor that is connected to the drive end 1132 causes the shaft 1130 to rotate. The inner magnet assembly 1200 is connected to, and therefore, rotated by the shaft 1130. The radially outward magnetic field of the inner magnet segments 1230 rotates along with inner magnet assembly 1200. In turn, the radially outward magnetic field of the inner magnet segments 1230 interacts with the radially inward magnetic field of the outer magnet segments 1540, such that it drives the rotor assembly or outer gear assembly 1500 to rotate synchronously with inner magnet assembly 1200, even though there is no physical contact between the outer gear assembly 1500 and the inner magnet assembly 1200.

The outer gear 1510 includes a plurality of (in this instance three or more) teeth 1517 that mesh with a plurality of teeth 1613 of the inner gear 1610. Rotation of the outer gear assembly 1500 causes engagement of the surfaces of the outer gear teeth 1517 with the surfaces of the inner gear teeth 1613, thereby causing the inner gear assembly 1600 to rotate.

The front portion 1100*a* of the casing 1100 provides a pumping cavity that is connected to a discharge port 1102 and an inlet port 1104. As the outer gear assembly 1500 and inner gear assembly 1600 rotate, the unmeshing of their teeth 1517 and 1613, respectively, causes an expanding first pumping pocket that pulls fluid into it from the inlet port 1104. As the outer gear assembly 1500 and inner gear assembly 1600 rotate further, the first pumping pocket moves clockwise until the teeth 1517 and 1613, respectively, begin to remesh, which causes the pumping pocket to collapse, forcing the fluid to be discharged out of the pump 1002 through discharge port 1102.

When pump 1002 is operating, the pumping action creates a pressure differential within the pump 1002, such that the pressure at the inlet port 1104 proximate the inner gear 1610 and nose cap 1330 at the suction end of the pump 1002 is lower than the pressure in the discharged fluid at the discharge port 1102. As may be seen in FIG. 21 in a simplified view of the pump 1002 without the inner magnet assembly 1200, the rear portion 1100*b* of the casing 1100, or the power end drive components, the pump 1002 includes a rather complex recirculation path P' that extends behind the rotor assembly or outer gear assembly 1500. The recirculation path P' begins at the discharge portion of the casing 1100 that forms the discharge port 1102, where the pressure is high, extends between stationary and rotating surfaces, and ends in front of the nose cap 1300, where the pressure is low.

The recirculation path P' is uniquely dynamic, because every portion of the path is bounded by a combination of a stationary surface and a rotating surface. This helps to avoid stagnation and clogging of the recirculation path P', which is used for lubrication and cooling of the pump components, such as the bushings and the canister assembly. The stationary surfaces are on the casing 1100 and components of the canister assembly 1300, including the radial rear flange 1302, the first cylindrical portion 1303, the central radially extending portion 1304, the second cylindrical portion 1305, and the nose cap 1330. The rotating surfaces are on the rotor assembly or outer gear assembly 1500 and the inner gear assembly 1600.

The recirculation path P' includes a longitudinal groove 1122 in the discharge side of the front portion 1100*a* of the casing that allows fluid to pass around a forward portion of the rotor assembly or outer gear assembly 1500, which otherwise has a close clearance fit with the front portion 1100*a*. The outer diameter of the rotor assembly 1500 is reduced rearward of the front portion, increasing the clearance between the rotor assembly 1500 and the central portion 1100*c* of the casing 1100. When the fluid from the groove 1122 in the front portion 1100*a* enters this area of greater clearance, it spreads out all the way around the rotor 1501 and into a cylindrical gap between the rotor assembly 1500 and the central portion 1100*c* of the casing 1100, and continues to move rearward. The recirculation path P' continues behind the rotor assembly 1500 and along the radial rear flange 1302 of the canister 1301, then moving forward along the first cylindrical portion 1303 and radially inward along the central radially extending portion 1304 of the canister 1301 and the rear surface 1564 of the bushing 1560 that provides the second or rearward axial bearing surface of the rotor assembly 1500. The rear surface 1564 of the bushing 1560 has a close clearance fit to the rear flange 1302, but the rear surface 1564 also includes a plurality of grooves 1570 that extend across surfaces of the bushing 1560, including the rear surface 1564 that provides a second or rearward axial bearing surface, inner surface 1566 that provides a radial bearing surface, and front surface 1562 that provides a first or forward axial bearing surface of the bushing 1560. This example pump 1002 includes four grooves 1570 in the bushing 1560, and as a result, the fluid splits into four separate streams corresponding to the four grooves 1570 as it passes over the axial and radial bearing surfaces of the bushing 1560. The four parallel paths continue through the grooves 1570 to the front surface 1562 of the bushing 1560. The four flow paths from the grooves 1570 come together at the front surface 1562 and meet an outer corner of the flange 1332 of the nose cap 1330, where a small donut shaped cavity 1574 is formed by a circumferential groove 1576 in the inner surface 1572 of the rotor 1501, a circumferential groove on the outer rear corner of the flange 1332 of the nose cap 1330, and a circumferential groove 1578 on the outer front edge of the bushing 1560. Continuing in the path P', the radial flange 1332 of the nose cap 1330 has a close clearance fit with the inner surface 1572 of the rotor, but fluid is permitted to pass through a groove 1340 that extends longitudinally along the outer edge of the flange 1332 and then radially inward across the front face 1333 of the nose cap 1330. The groove 1340 leads the fluid flow to a flat surface 1342 in the front gear support extension 1336, which permits fluid to flow forward between the front gear support extension 1336 and the inner gear bushing 1620, to a groove 1124 in the front portion 1100*a* of the casing 1100. This further groove 1124 allows the fluid to flow through to the suction side at the inlet port 1104, completing the recirculation path P' of the pump 1100.

From the above disclosure, it will be apparent that pumps constructed in accordance with this disclosure may include a number of structural aspects that provide advantages over conventional constructions, depending upon the specific design chosen.

It will be appreciated that pumps constructed in accordance with the present disclosure may be provided in various configurations. Any variety of suitable materials of construction, configurations, shapes and sizes for the components and methods of connecting the components may be utilized to meet the particular needs and requirements of an end user. Indeed, pumps in accordance with the present disclosure may include interior surfaces that are constructed of specific materials and/or have particular surface finishes wherein the interior surfaces permit use of the pumps in hygienic applications where microbial growth must be prevented. It will be apparent to those skilled in the art that various modifications can be made in the design and construction of such pumps without departing from the scope or spirit of the claimed subject matter, and that the claims are not limited to the preferred embodiment illustrated herein. It also will be appreciated that some aspects of the example embodiment are discussed in a simplified manner and the aspects may be capable of being implemented in rotodynamic pumps, positive-displacement pumps, and whether such pumps include dynamic seals between rotating parts or are magnetically driven.

The invention claimed is:

1. A magnetically driven pump comprising:

a casing having a front portion, a rear portion, a discharge port and an inlet port;

a rotor assembly further comprising a rear opening having an inner wall surface and having a plurality of magnet segments connected to the inner wall surface, a central cylindrical opening having an inner wall surface that provides a radial bearing surface, a first axial bearing surface, and a second axial bearing surface;

an inner magnet assembly further comprising an inner ring and a plurality of magnet segments connected to an outer surface of the inner ring and being in axial alignment with the magnet segments of the rotor assembly;

a canister assembly further comprising a cylindrical portion disposed within a radial gap between the magnet segments of the inner magnet assembly and the magnet segments of the rotor assembly, and a front portion extending from the cylindrical portion and having a radial bearing surface, a first axial bearing surface, and a second axial bearing surface;

wherein the radial bearing surface of the rotor assembly and the radial bearing surface of the canister assembly front portion restrict radial motion of the rotor assembly, the first axial bearing surface of the rotor assembly and the first axial bearing surface of the canister assembly front portion restrict forward motion of the rotor assembly, and the second axial bearing surface of the rotor assembly and the second axial bearing surface of the canister assembly front portion restrict rearward motion of the rotor assembly.

2. The pump according to claim 1, wherein the canister assembly front portion is spaced apart from the casing front portion.

3. The pump according to claim 1, wherein the canister assembly front portion is supported by the casing front portion.

4. The pump according to claim 1, wherein the pump is a rotodynamic pump and the rotor assembly further comprises an impeller.

5. The pump according to claim 1, wherein the pump is a positive-displacement gear pump and the rotor assembly further comprises an outer gear.

6. The pump according to claim 1, further comprising:

a recirculation path that extends from the casing discharge port, across the radial bearing surface of the rotor assembly, across the first and second axial bearing surfaces of the rotor assembly, across the cylindrical portion of the canister assembly, and to the casing inlet port;

wherein when the rotor assembly rotates within the casing and relative to the canister assembly, all portions of the recirculation path include at least one stationary surface of the casing or canister assembly that is opposed to at least one surface of the rotor assembly.

7. The pump according to claim 6, wherein the pump is a rotodynamic pump and the rotor assembly further comprises an impeller.

8. The pump according to claim 6, wherein the pump is a positive-displacement gear pump and the rotor assembly further comprises an outer gear.

9. A magnetically driven rotodynamic pump comprising:

a stationary casing having a discharge port, an inlet port, a mounting foot and a rear mounting flange;

an inner magnet assembly having an inner ring and a plurality of magnet segments;

an impeller assembly comprising an impeller, at least one radial bearing surface, at least one axial bearing surface and a plurality of magnet segments;

wherein the casing, inner magnet assembly and impeller assembly are configured and dimensioned to be assembled to a power end and adapter of a commercially available non-magnetically driven rotodynamic pump having a dynamic seal that is designed in accordance with dimensions specified in a pump industry standard, such that when assembled, the sizes and locations of the casing discharge port, the casing inlet port, the casing mounting foot, and the power end and adapter all meet the dimensions specified in the standard.

10. The pump according to claim 9, wherein the pump industry standard is ASME B73.1.

11. The pump according to claim 9, wherein the pump industry standard is ISO 5199.

12. A magnetically driven rotodynamic pump comprising:

a stationary casing having a front portion, a rear portion, a discharge port and an inlet port;

a stationary canister assembly connected to the stationary casing;

the stationary canister assembly further comprising a canister and a stationary nose cap connected to the canister and having an outer diameter, a rear axial bearing surface and a front surface;

a rotatable rotor assembly further comprising an impeller having a plurality of front vanes;

wherein a portion of the impeller vanes extend forward of the nose cap front surface and inward to an inner diameter that is smaller than the outer diameter of the nose cap.

13. A pump comprising:

a stationary casing having a front portion, a rear portion, a discharge port and an inlet port;

a rotor assembly further comprising a bushing wherein the bushing is of single piece construction and includes a radial bearing surface that restricts radial motion of the rotor assembly, a front axial bearing surface that restricts forward motion of the rotor assembly, and a rear axial bearing surface that restricts rearward motion of the rotor assembly.

14. The pump according to claim 13, wherein the pump is magnetically driven, the rotor assembly further comprises a plurality of magnet segments, the pump further comprises a drive magnet assembly having a plurality of magnet segments in axial alignment with the magnet segments of the rotor assembly, and the pump further comprises a canister assembly having a cylindrical portion disposed within a radial gap between the magnet segments of the rotor assembly and the magnet segments of the drive magnet assembly.

15. The pump according to claim 13, wherein the pump further comprises a rotodynamic pump and the rotor assembly further comprises an impeller.

16. The pump according to claim 13, wherein the pump further comprises a positive-displacement gear pump and the rotor assembly further comprises an outer gear.

17. The pump according to claim 14, wherein the pump further comprises a rotodynamic pump and the rotor assembly further comprises an impeller.

18. The pump according to claim 14, wherein the pump further comprises a positive-displacement gear pump and the rotor assembly further comprises an outer gear.

19. A pump comprising:

a stationary casing having a front portion, a rear portion, a discharge port and an inlet port;

a rotor assembly further comprising a rotor that includes a central opening extending axially through the rotor and having a step proximate one end of the central opening, a separate rotor ring, and a separate bushing;

wherein the separate bushing fits inside the rotor central opening and is axially held in place by the separate rotor ring and the step in the central opening of the rotor when the separate rotor ring is connected to the rotor.

20. The pump according to claim 19, wherein the pump is magnetically driven, the rotor assembly further comprises a plurality of magnet segments, the pump further comprises a drive magnet assembly having a plurality of magnet segments in axial alignment with the magnet segments of the rotor assembly, and the pump further comprises a canister assembly having a cylindrical portion disposed within a radial gap between the magnet segments of the rotor assembly and the magnet segments of the drive magnet assembly.

* * * * *